US006766600B2

(12) United States Patent
Ogura et al.

(10) Patent No.: US 6,766,600 B2
(45) Date of Patent: Jul. 27, 2004

(54) DISPLAY DEVICE AND DISPLAY CONTROLLER OF CONSTRUCTION MACHINERY

(75) Inventors: Hiroshi Ogura, Ryugasaki (JP); Hiroshi Watanabe, Ushiku (JP); Kazuo Fujishima, Ibaraki-ken (JP); Sadahisa Tomita, Ibaraki-ken (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 10/169,939

(22) PCT Filed: Nov. 9, 2001

(86) PCT No.: PCT/JP01/09804

§ 371 (c)(1),
(2), (4) Date: Jul. 11, 2002

(87) PCT Pub. No.: WO02/40783

PCT Pub. Date: May 23, 2002

(65) Prior Publication Data

US 2003/0001751 A1 Jan. 2, 2003

(30) Foreign Application Priority Data

Nov. 17, 2000 (JP) ..... 2000-350906

(51) Int. Cl.[7] ..... G05D 1/02
(52) U.S. Cl. ..... 37/348
(58) Field of Search ..... 37/348, 382; 172/2, 172/3, 4.5, 5, 6; 701/50; 111/200

(56) References Cited

U.S. PATENT DOCUMENTS 5,404,661 A * 4/1995 Sahm et al. ..... 37/348
5,854,988 A 12/1998 Davidson et al.
5,887,365 A 3/1999 Fujishima et al.
5,919,242 A * 7/1999 Greatline et al. ..... 701/50
5,978,723 A * 11/1999 Hale et al. ..... 701/50
5,995,894 A * 11/1999 Wendte ..... 701/50
6,061,617 A * 5/2000 Berger et al. ..... 701/50
6,070,538 A * 6/2000 Flamme et al. ..... 111/170
6,070,673 A * 6/2000 Wendte ..... 172/2
6,091,997 A * 7/2000 Flamme et al. ..... 700/83
6,112,144 A * 8/2000 Allen ..... 701/50
6,141,612 A * 10/2000 Flamme et al. ..... 701/50
6,195,604 B1 * 2/2001 Moore et al. ..... 701/50
6,236,924 B1 * 5/2001 Motz et al. ..... 701/50
6,266,595 B1 * 7/2001 Greatline et al. ..... 701/50
6,285,930 B1 * 9/2001 Dickson et al. ..... 701/28
6,360,167 B1 * 3/2002 Millington et al. ..... 701/211
6,405,126 B1 * 6/2002 Palomo et al. ..... 701/202
6,490,539 B1 * 12/2002 Dickson et al. ..... 702/150
6,564,143 B1 * 5/2003 Alewine et al. ..... 701/207

FOREIGN PATENT DOCUMENTS

| | | |
|---|---|---|
| JP | 5-287782 | 11/1993 |
| JP | 6-257189 | 9/1994 |
| JP | 7-271596 | * 10/1995 |
| JP | 8-218444 | 8/1996 |
| JP | 10-103925 | * 4/1998 |
| JP | 11-286971 | 10/1999 |

* cited by examiner

*Primary Examiner*—Victor Batson
(74) *Attorney, Agent, or Firm*—Mattingly, Stanger & Malur, P.C.

(57) ABSTRACT

A display unit for a construction machine is provided which allow for an operator to easily set a target plane or area in works to be performed under automatic control, and to freely change the contents to be displayed regardless of whether the machine is under the automatic control, so that information which the operator wants to see can be promptly displayed.

9 Claims, 17 Drawing Sheets

DISPLAY DEVICE AND DISPLAY CONTROLLER OF CONSTRUCTION MACHINERY

TECHNICAL FIELD

The present invention relates to a display unit and a display control unit for a construction machine, each of which is provided in a cab of the construction machine and displays positional information of a front attachment, such as a bucket end position.

BACKGROUND ART

A hydraulic excavator is known as a typical example of construction machines. In the hydraulic excavator, an operator operates front members such as a boom, i.e., constituent members of a front attachment, with corresponding manual control levers. However, it is difficult for the operator to determine whether a trench with a predetermined depth or the face of a slope with a predetermined gradient is precisely excavated, only by visually observing the operation of the front attachment.

FIG. 12 in Specification of U.S. Pat. No. 5,887,365 shows a monitoring unit, i.e., EX-200X Level Master made by Hitachi Construction Machinery Co., Ltd., which is a unit provided in a hydraulic excavator for displaying positional information of a bucket as a working device located at a fore end of a front attachment and for setting a preset target excavation plane when a bucket position is controlled so as not to protrude out of the preset target excavation plane. Such a monitoring unit displays just numerically the positional information of the bucket and setting information of the target excavation plane.

Also, a display unit disclosed in JP,A 10-103925 is known as a unit for entering setting values of depth and gradient for automatic control of a front attachment, and displaying a target excavation plane based on the setting values and the bucket position. The disclosed display unit is able to represent four kinds of setup screens for numerically displaying setting information of the target excavation plane, etc. corresponding to four kinds of control modes, and allows for an operator to set the target excavation plane using the setup screens. When a separately provided trigger switch is depressed in each of the setup screens, automatic control is started and the setup screen is changed to an under-control screen on which the bucket, the target excavation plane, etc. are displayed in the form of symbolic illustrations. Further, the display unit is constructed in the form of a touch panel, and the operator depresses the touch panel to change the setup screen from one to another and to enter numerical values on each of the setup screens.

DISCLOSURE OF INVENTION

The monitoring unit described in U.S. Pat. No. 5,887,365 displays numerically the positional information of the working device located at the fore end of the front attachment and the setting information of the target excavation plane. This gives rise to a problem that it is difficult for the operator to visually recognize the position of the working device located at the fore end of the front attachment and the setting state of the target excavation plane with the aid of display of the numerical values only.

The display unit disclosed in JP,A 10-103925 also has a similar problem because the setup screens used for setting the target excavation plane, etc. display numerically the setting information.

Further, the disclosed display unit has the following problems because its primary object resides in making setting for automatic control.

1) When automatic control is started, the setup screen is changed to the under-control screen on which the bucket, the target excavation plane, etc. are displayed in the form of symbolic illustrations. However, the display unit lacks flexibility in selection of the displayed contents. Once the under-control screen is displayed, a shift to another screen is not allowed until the relevant control comes to an end. Accordingly, the operator cannot see the positional information, such as the body tilt angle and the bucket end height, during the automatic control.

2) During a period in which the automatic control is not performed, the setup screen is only displayed. Therefore, the operator cannot see the attitude of the body and the bucket or the target excavation plane during the period not under control.

3) Entry of numerical values for the automatic control is made using the touch panel of the display unit. The site where hydraulic excavators are working, however, undergoes severe environmental conditions in points of, e.g., dust and temperature. Further, the operator often depresses the touch panel with a glove or the like put on the hand. This gives rise to a problem in operability and durability.

A first object of the present invention is to provide a display unit and a display control unit for a construction machine, which allow for an operator to easily set a target plane or area in works to be performed under automatic control, and to freely change the contents to be displayed regardless of whether the machine is under the automatic control, so that information which the operator wants to see can be promptly displayed.

A second object of the present invention is to provide a display unit for a construction machine, which is superior in operability and durability in addition to the above advantages.

(1) To achieve the above first object, the present invention provides a display unit for a construction machine, the display unit being provided in a cab of the construction machine including a front attachment, and comprising a display portion for displaying positional information of the front attachment and setting information for automatic control of the front attachment, and an operating portion for instructing change of contents displayed on the display portion, thereby controlling the displayed contents in accordance with an instruction from the operating portion, wherein the display portion is capable of selectively displaying a first screen for displaying the setting state of a target plane or area in works to be performed under automatic control by using numerical values and a movable symbolic illustration, and at least one second screen for providing another display, each of the first and second screens having a menu area used for changing the first and second screens from one to the other in accordance with an instruction from the operating portion.

Since the display portion is capable of selectively displaying the first screen for displaying the setting state of the target plane or area in works by using numerical values and a movable symbolic illustration, and at least one second screen for providing another display, various settings for the automatic control can be made by displaying the first screen. Also, since each of the first and second screens has a menu area for screen change, a screen image can be changed from the first screen to the second screen or vice versa by instructing screen change with manipulation made on the operating portion. Therefore, the screen image can be changed to the second screen even under control so that the operator can confirm positional information of the body, etc., and the screen image can be changed to the first screen even under not control so that the operator can set the automatic control or confirm the setting state. Thus, the contents to be displayed can be freely changed regardless of whether the machine is under the automatic control, and the information that the operator wants to see can be promptly displayed. Hence, an improvement of the work efficiency is expected.

(2) To achieve the second object, in the present invention according to above (1), the operating portion includes selection keys, numerical value entry keys, and a decision key; the first screen changes display of the setting state upon manipulation of the numerical value entry keys; and the menu area in each of the first and second screens is used for changing the first and second screens from one to the other with manipulation of the selection keys and the decision key.

With those features, the display portion is no longer required to use a touch panel, and operability and durability of the display unit can be improved even in any site where construction machines are working.

(3) In above (1), preferably, when the automatic control is started, each of the first and second screens displays that the construction machine is under control.

With that feature, even when the screen image on the display portion is changed to any screen, the operator is able to know that the machine is currently under the automatic control, and hence to perform works without anxiety.

(4) In above (1), preferably, the second screen includes a screen for displaying, in enlarged scale, the positional relationship of a fore end of the front attachment relative to the target plane or area in the works by using a movable symbolic illustration.

With that feature, when works are performed in a location where the operator cannot visually confirm the position of the bucket fore end, the operator is able to perform the works while always confirming the position of the bucket fore end and the position of the target plane or area in the works by looking at the second screen. The excavation monitoring screen is effective. Further, since the screen image can be changed to the second screen even when the automatic control is turned OFF, excavation works to obtain the target plane or area can be performed with the operator's operation while looking at the second screen.

(5) In above (1), preferably, the menu area has a plurality of items including an item of screen change; the operating portion includes first entry means for selecting a desired one of the plurality of items in the menu area, and second entry means for deciding the selection made by the first entry means; and the display portion changes the first and second screens from one to the other when the item of screen change is selected by the first entry means and the selection of the item of screen change is decided by the second entry means.

With those features, the first and second screens can be changed from one to the other using the operating portion (first and second entry means) and the menu area.

(6) In above (1), preferably, the menu area of the first screen has an item of screen change and an item of automatic control ON/OFF; and the display portion changes the first and second screens from one to the other regardless of the selected state of the item of automatic control ON/OFF when selection of the item of screen change is instructed from the operating portion.

With those features, the first and second screens can be freely changed from one to the other with the aid of the menu area regardless of whether the machine is under the automatic control.

(7) In above (1), preferably, the menu area of the first screen has a plurality of items including an item of screen change and an item of automatic control ON/OFF; the menu area of the second screen has a plurality of items including an item of screen change; the operating portion includes first entry means for selecting a desired one of the plurality of items in the menu area, and second entry means for deciding the selection made by the first entry means; and when one item is selected by the first entry means and the selection of the one item is decided by the second entry means, the display portion executes the selected item.

With those features, the first and second screens can be freely changed from one to the other with the aid of the menu area upon manipulation of the first and second entry means regardless of whether the machine is under the automatic control.

(8) Also, to achieve the above first object, the present invention provides a display unit for a construction machine, the display unit being provided in a cab of the construction machine including a front attachment, and comprising a display portion for displaying positional information of the front attachment and setting information for automatic control of the front attachment, and an operating portion for instructing change of contents displayed on the display portion, thereby controlling the displayed contents in accordance with an instruction from the operating portion, wherein the display portion is capable of selectively displaying a first screen for displaying the setting state of a target plane or area in works to be performed under automatic control by using numerical values and a movable symbolic illustration, a second screen for displaying sates of a body of the construction machine and the front attachment by using numerical values and a movable symbolic illustration, and a third screen for displaying, in enlarged scale, the positional relationship of a fore end of the front attachment relative to the target plane or area in the works by using a movable symbolic illustration, each of the first, second and third screens having a menu area used for changing the first, second and third screens from one to another in accordance with an instruction from the operating portion.

With those features, as described in above (1), the target plane or area in the works to be performed under the automatic control can be easily set, and the contents to be displayed can be freely changed regardless of whether the machine is under the automatic control. Hence, information that the operator wants to see can be promptly displayed, and the work efficiency can be improved.

(9) Further, to achieve the above first object, the present invention provides a display control unit for a construction machine, the display control unit being provided in a cab of the construction machine including a front attachment and controlling, in accordance with an instruction from an operating portion, contents displayed on a display portion for displaying positional information of the front attachment and setting information for automatic control of the front attachment, the display control unit comprising first control means for causing the display portion to selectively display a first screen for displaying the setting state of a target plane or area in works to be performed under automatic control by using numerical values and a movable symbolic illustration, and at least one second screen for providing another display, and to display a menu area including an item of screen change in each of the first and second screens; and second control means for processing the item of screen change in accordance with an instruction from the operating portion and changing the first and second screens from one to the other.

With those features, as described in above (1), the target plane or area in the works to be performed under the automatic control can be easily set, and the contents to be displayed can be freely changed regardless of whether the machine is under the automatic control. Hence, information that the operator wants to see can be promptly displayed, and the work efficiency can be improved.

BEST MODE FOR CARRYING OUT THE INVENTION

Hereinbelow, an embodiment of the present invention will be described with reference to the drawings.

Figure 1:
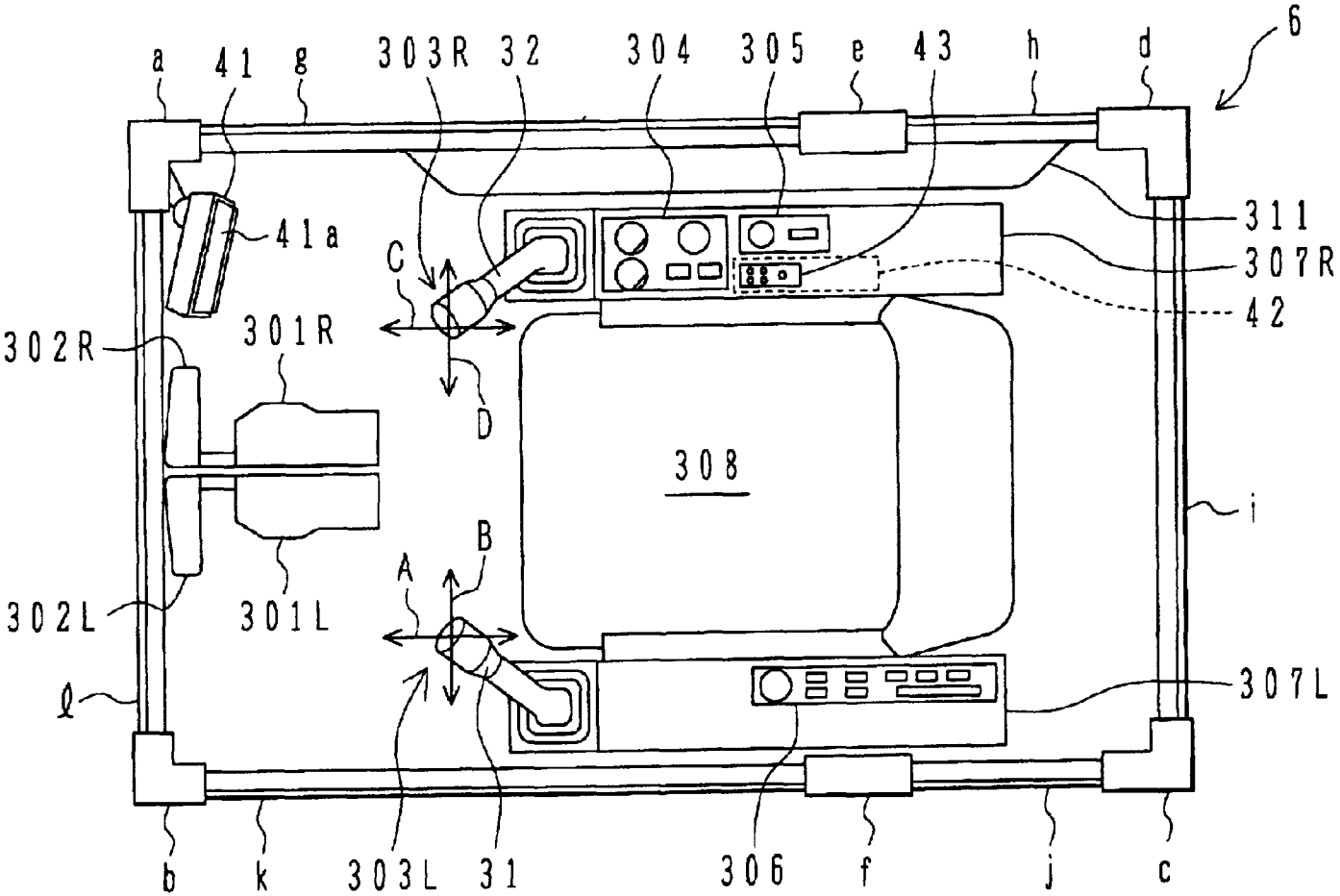
FIG. 1 is a plan view showing a layout in a cab of a hydraulic excavator provided with a display unit according to one embodiment of the present invention.

FIG. 1 is a plan view showing a layout in a cab of a hydraulic excavator provided with a display unit according to the embodiment of the present invention.

In FIG. 1, numeral 6 denotes the entirety of the cab. Four sides of the cab 6 are surrounded by corner flames a, b, c, d, side frames e, f, and windowpanes g to l. An operator seat 308 is provided inside the cab 6. Also, inside the cab 6, control lever units 303L, 303R for operating a front attachment and swinging a body are disposed on both side of a front portion of the operator seat 308, travel pedals 301L, 301R and travel levers 303L, 303R are disposed in front of the operator seat 308, and console boxes 307L, 307R are disposed both sides of the operator seat 308. In the console boxes 307L, 307R, there are provided a console panel 304, an air conditioner unit 305, a radio 306, and so on, the console panel 304 including monitors for indicating the temperature of a hydraulic working fluid (oil), the remaining amount of fuel, etc., and switches for setting an operating mode and an engine target revolution speed.

Figure 2:
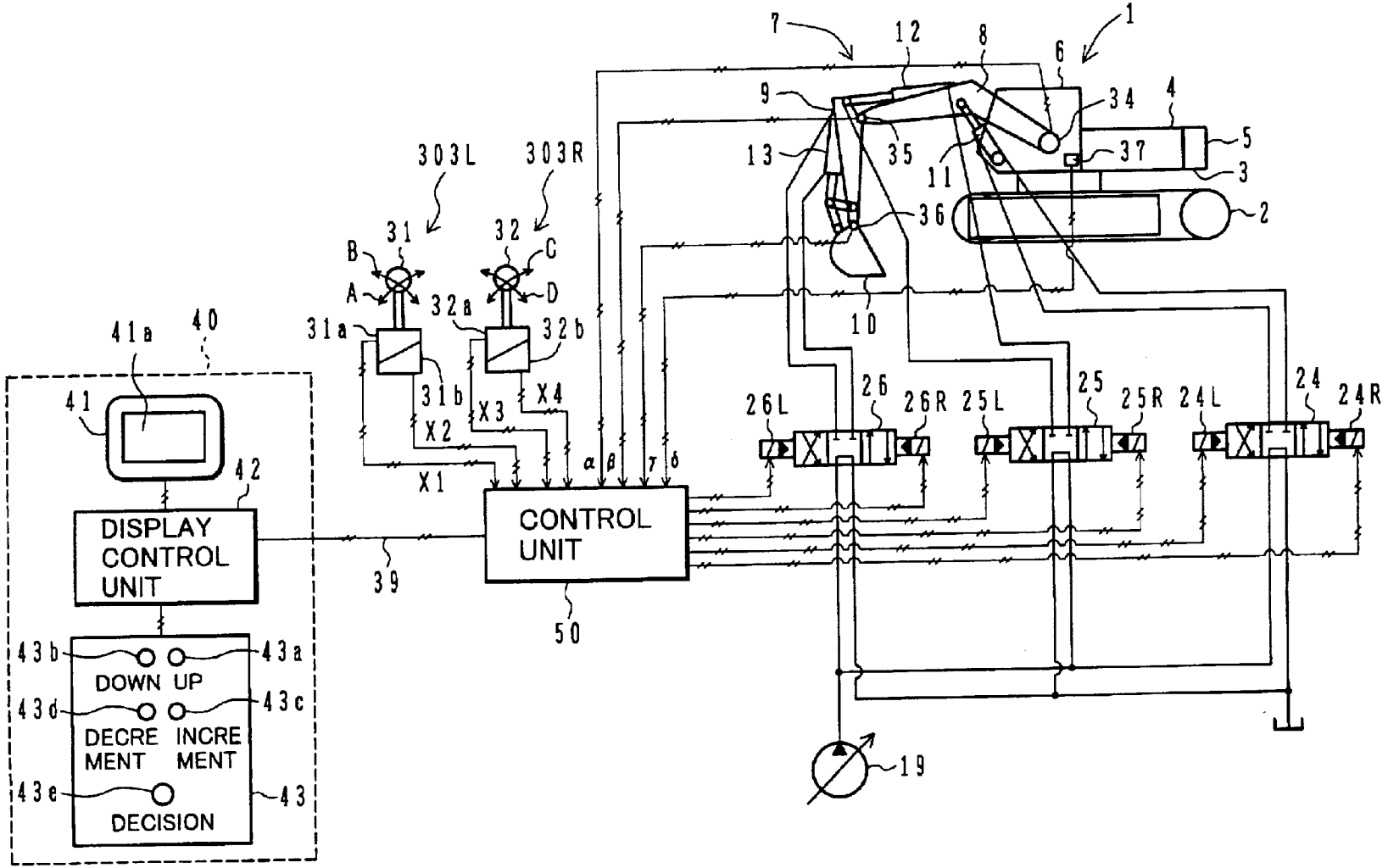
FIG. 2 is a block diagram showing the display unit according to one embodiment of the present invention along with a hydraulic excavator and a hydraulic circuit thereof.

FIG. 2 is a block diagram showing the display unit according to one embodiment of the present invention along with a hydraulic excavator and a hydraulic circuit thereof. A hydraulic excavator 1 comprises a lower track structure 2, an upper swing structure 3, and a front attachment 7. The upper swing structure 3 is driven to revolve by a swing motor (not shown) mounted on the lower track structure 2, and the front attachment 7 is vertically rotatably mounted to a front portion of the upper swing structure 3. The upper swing structure 3 comprises an accommodating room 4, a counterweight 5, the cab 6, and so on. The front attachment 7 is of a multi-articulated structure comprising a boom 8, an arm 9 and a bucket 10. The boom 8, the arm 9 and the bucket 10 are driven to rotate by a boom cylinder 11, an arm cylinder 12 and a bucket cylinder 13, respectively.

The boom cylinder 11, the arm cylinder 12 and the bucket cylinder 13 are connected to a hydraulic pump 19 through control valves 24, 25, 26, respectively. The flow rates and directions of hydraulic fluids supplied from the hydraulic pump 19 to the respective cylinders 11, 12, 13 are adjusted by the control valves 24, 25, 26. Though not shown for simplicity of the drawing, the hydraulic excavator 1 further includes the swing motor and a corresponding swing control valve. The swing control valve controls the flow rate and direction of a hydraulic fluid supplied from the hydraulic pump 19 to the swing motor.

The control lever units 303L, 303R are provided in association with the control valves 24, 25, 26 and the swing control valve. The control lever units 303L, 303R include respectively control levers 31, 32 and potentiometers 31*a*, 31*b*, 32*a*, 32*b*. When the control lever 31 is operated in a back-and-forth direction A, a stroke by which the control lever 31 is operated is detected by the potentiometer 31*a*, which outputs an electrical operating signal X1 depending on the lever stroke. When the control lever 31 is operated in a left-and-right direction B, a stroke by which the control lever 31 is operated is detected by the potentiometer 31*b*, which outputs an electrical operating signal X2 depending on the lever stroke. When the control lever 32 is operated in a back-and-forth direction C, a stroke by which the control lever 32 is operated is detected by the potentiometer 32*a*, which outputs an electrical operating signal X3 depending on the lever stroke. When the control lever 32 is operated in a left-and-right direction D, a stroke by which the control lever 32 is operated is detected by the potentiometer 32*b*, which outputs an electrical operating signal X4 depending on the lever stroke.

The operating signals X1, X2, X3, X4 outputted from the potentiometers 31*a*, 31*b*, 32*a*, 32*b* are sent to a control unit 50. The control unit 50 executes predetermined computations based on the operating signals X1, X2, X3, X4, and outputs control signals to solenoid proportional valves 24L, 24R, 25L, 25R, 26L, 26R and a solenoid proportional valve provided in the swing control valve (not shown). The solenoid proportional valves 24L, 24R, 25L, 25R, 26L, 26R are provided for hydraulic driving of the control valves 24, 25, 26 such that the shift directions and opening degrees of the control valves 24, 25, 26 are regulated in accordance with respective pilot pressures instructed by the solenoid proportional valves 24L. 24R, 25L, 25R, 26L, 26R. The solenoid proportional valve provided in the swing control valve also operates in a similar manner. As a result, the directions and flow rates of the hydraulic fluids supplied from the hydraulic pump 19 to the boom cylinder 11, the arm cylinder 12, the bucket cylinder 13, and the swing motor (not shown) are limited.

Also, a rotational angle sensor 34 for detecting the rotational angle of the boom 8 is disposed on the boom 8, an arm rotational angle sensor 35 for detecting the rotational angle of the arm 9 is disposed on the arm 9, and a bucket angle sensor 36 for detecting the rotational angle of the bucket 10 is disposed on the bucket 10. The boom rotational angle sensor 34, the arm rotational angle sensor 35, and the bucket rotational angle sensor 36 output electrical angle signals $\alpha$, $\beta$, $\gamma$, respectively, depending on the attitude of the front attachment 7.

Further, a transverse tilt angle sensor 37 for detecting the transverse tilt angle sensor of the body is disposed inside the cab 6 to output an electrical angle signal $\sigma$ depending on the transverse tilt angle of the body.

The angle signals $\alpha$, $\beta$, $\gamma$, $\sigma$ outputted from the boom rotational angle sensor 34, the arm rotational angle sensor 35, the bucket rotational angle sensor 36 and the transverse tilt angle sensor 37 are inputted to the control unit 50. The control unit 50 computes the position of the fore end of the bucket 10, etc. based on the angle signals $\alpha$, $\beta$, $\gamma$, and outputs via a serial communication line 39 a computed result, as display data, to the display unit 40 according to this embodiment. Moreover, in accordance with an instruction (described later) to start automatic control, the control unit 50 executes, e.g., area limiting control in which the front attachment 7 is controlled so as not to protrude out of the set range with the operation of the operator, area limiting excavation control in which when the front attachment 7 is about to protrude out of the set range, it is controlled so as to operate along the set range, or locus control in which the front attachment 7 is controlled so as to operate along the set locus.

The display unit 40 comprises a display 41, a display control unit 42, and an operating unit 43. The display data from the control unit 50 is inputted to the display control unit 42. The display control unit 42 displays the inputted display data on the display 41, and transmits data instructing the displayed contents and the contents of computation, which are required for the control unit 50, or numerical value data, such as the depth and gradient of the target excavation plane, for automatic control to the control unit 50 via the serial communication line 39 in accordance with an operating signal from the operating unit 43.

Returning to FIG. 1, the display 41 is attached to the corner frame a diagonally to the right of the operator seat 308 inside the cab 6, the display control unit 42 is housed in the console box 307R on the right side, and the operating unit 43 is also provided in the console box 307R on the right side.

The display 41 includes, e.g., an LCD 41*a* serving as an image display portion.

The operating unit 43 includes, as shown in FIG. 2, up and down selection keys 43*a*, 43*b*, numerical value increment and decrement entry keys 43*c*, 43*d*, and a decision key 43*e*.

Figure 3:
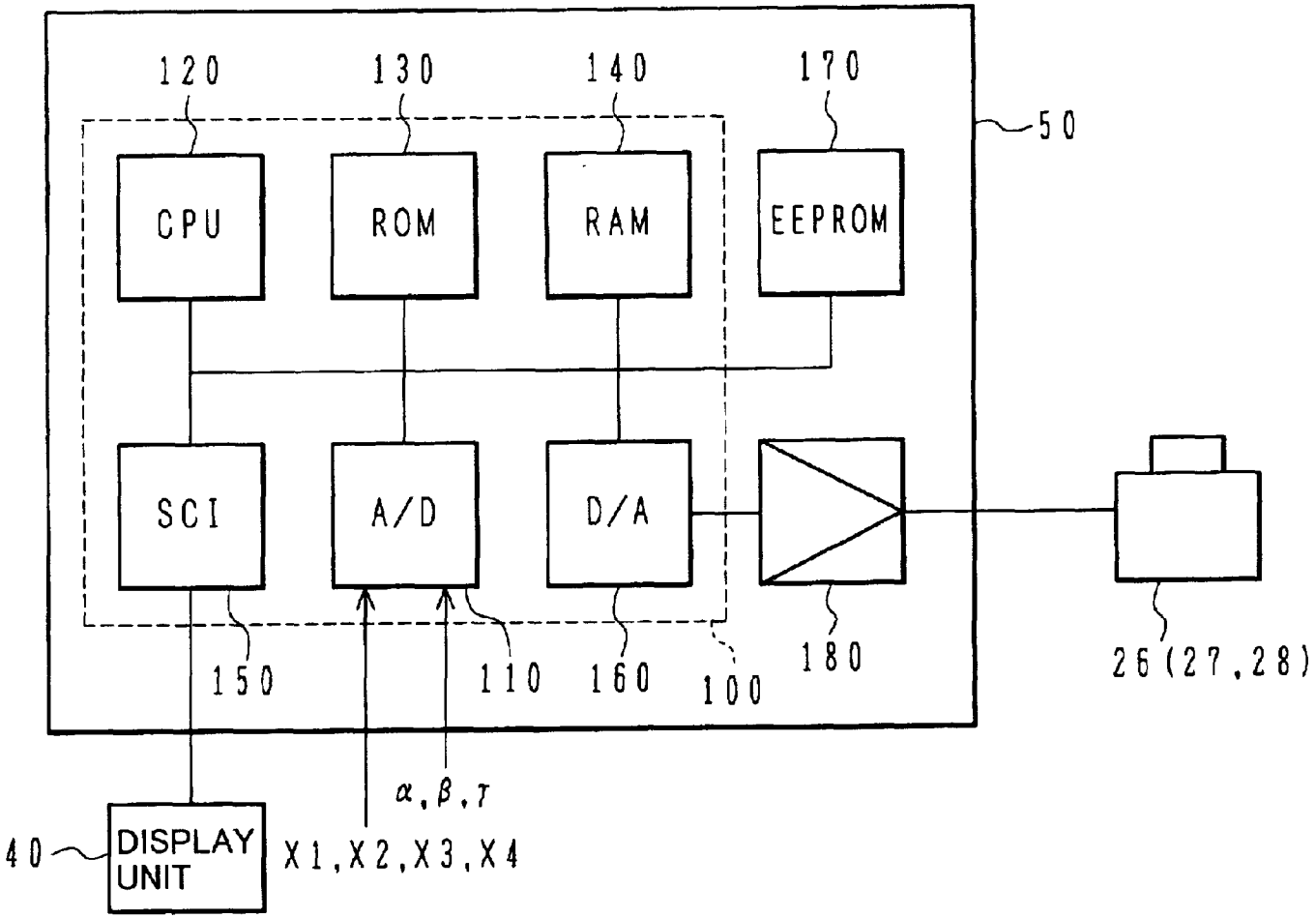
FIG. 3 is a block diagram showing a configuration of a control unit for the hydraulic excavator shown in FIG. 2.

FIG. 3 shows a configuration of the control unit 50. The control unit 50 comprises a single-chip microcomputer 100, a nonvolatile memory (EEPROM) 170 for storing control constants, dimensional data, etc. for each model and each grade, and an amplifier 180. The single-chip microcomputer 100 includes an A/D converter 110 for converting the angle signals $\alpha$, $\beta$, $\gamma$, $\sigma$ inputted respectively from the boom rotational angle sensor 34, the arm rotational angle sensor 35, the bucket rotational angle sensor 36 and the transverse tilt angle sensor 37 and the operating signals X1, X2, X3, X4 inputted respectively from the potentiometers 31*a*, 31*b*, 32*a*, 32*b* into digital signals; a central processing unit (CPU) 120; a read only memory (ROM) 130 for storing programs for control procedures and constants necessary for control; a random access memory (RAM) 140 for temporarily storing numerical values given as computed results or obtained in the course of computation; a serial communication interface (SCI) 150 for communicating with the control unit 42 in the display unit 40; and a D/A converter 160 for converting digital signals into analog signals.

Figure 4:
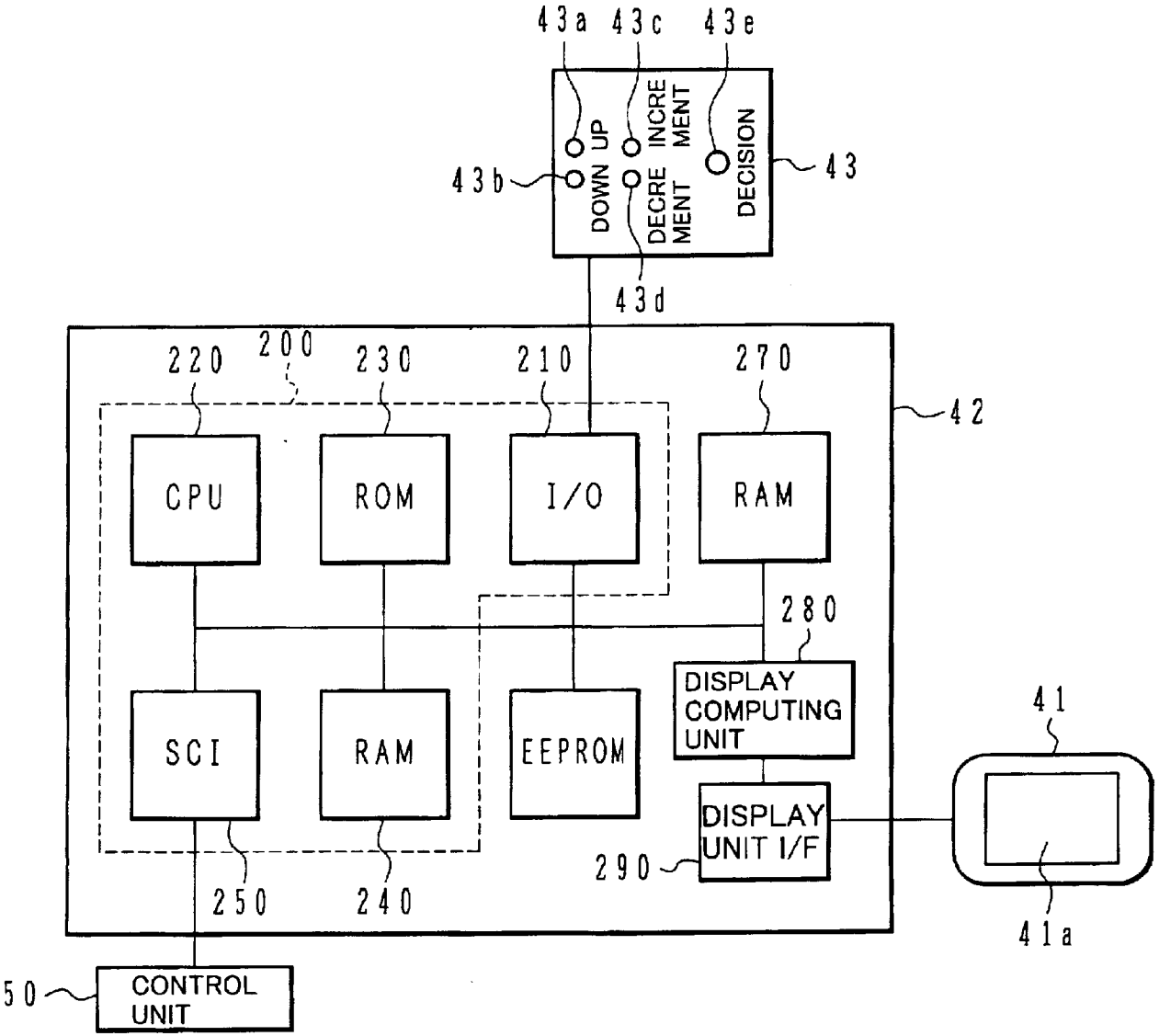
FIG. 4 is a block diagram showing a configuration of a display control unit shown in FIG. 2.

FIG. 4 shows a configuration of the display control unit 42 in the display unit 40. The display control unit 42 comprises a single-chip microcomputer 200, a memory 270 used for drawing or processing the contents to be displayed on the display 41, a display computing portion 280 for executing computation required for providing display, and an interface 290 for outputting the displayed contents, which are created by the display computing portion 280. The single-chip microcomputer 100 includes an interface (I/O) 210 for taking in the operating signal from the operating unit 43; a central processing unit (CPU) 220; a read only memory (ROM) 230 for storing programs for control procedures and constants necessary for control; a random access memory (RAM) 240 for temporarily storing numerical values given as computed results or obtained in the course of computation; a serial communication interface (SCI) 250 for communicating with the control unit 42 in the control unit 50.

Next, the contents displayed on the display 41 will be described.

Figure 5A:
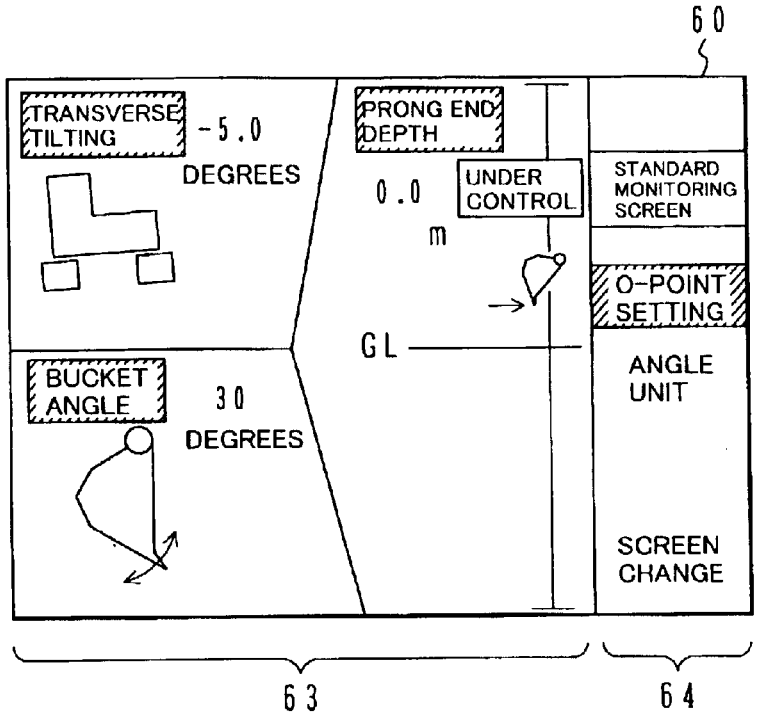
FIG. 5A is a representation showing a standard monitoring screen displayed on the display unit according to one embodiment of the present invention.
Figure 5B:
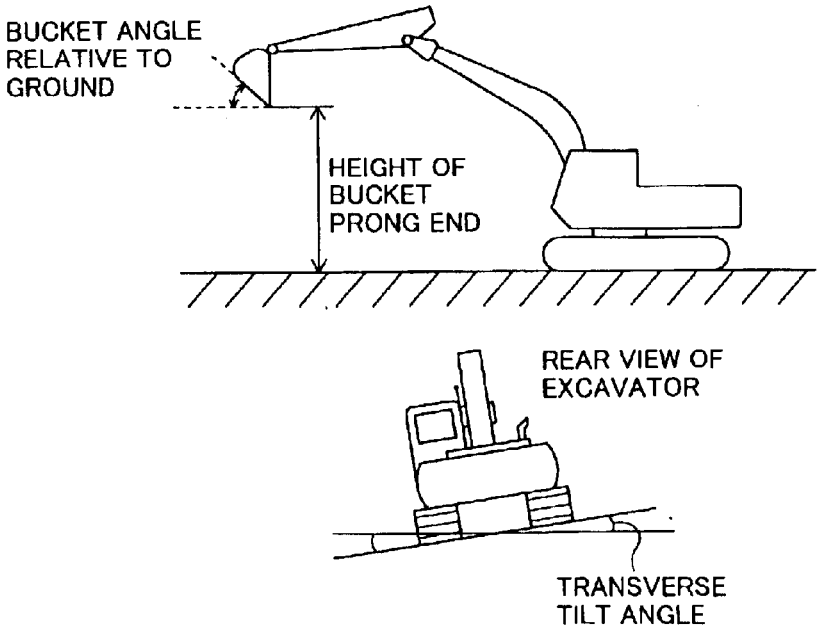
FIG. 5B is a representation for explaining the displayed contents.
Figure 6A:
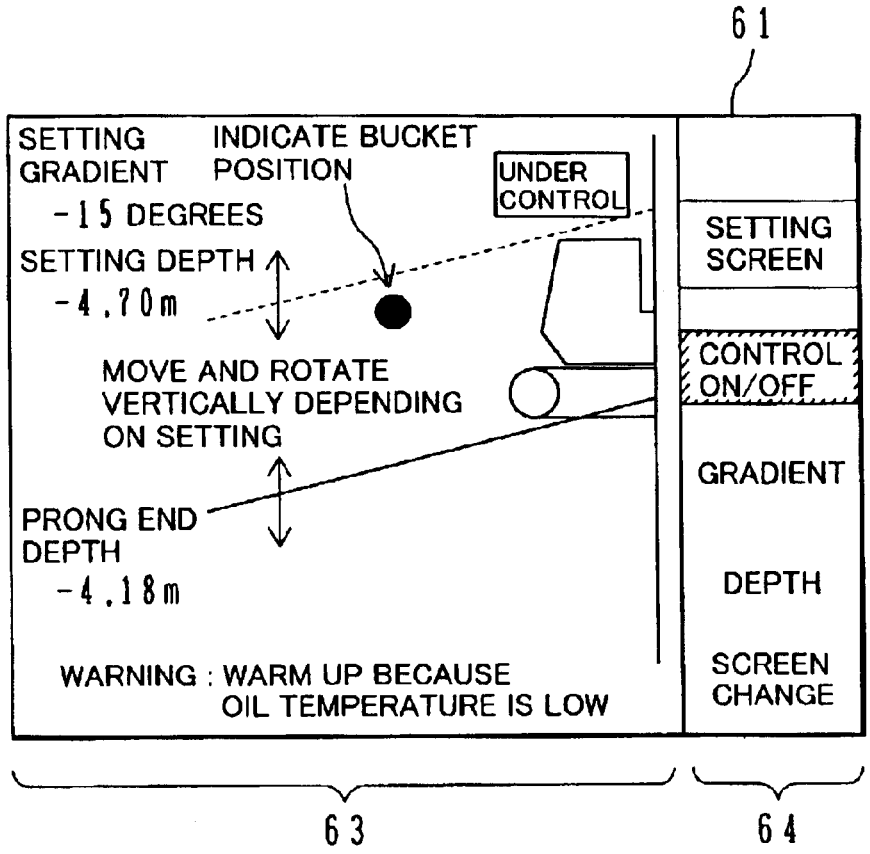
FIG. 6A is a representation showing an excavation setting screen displayed on the display unit.
Figure 6B:
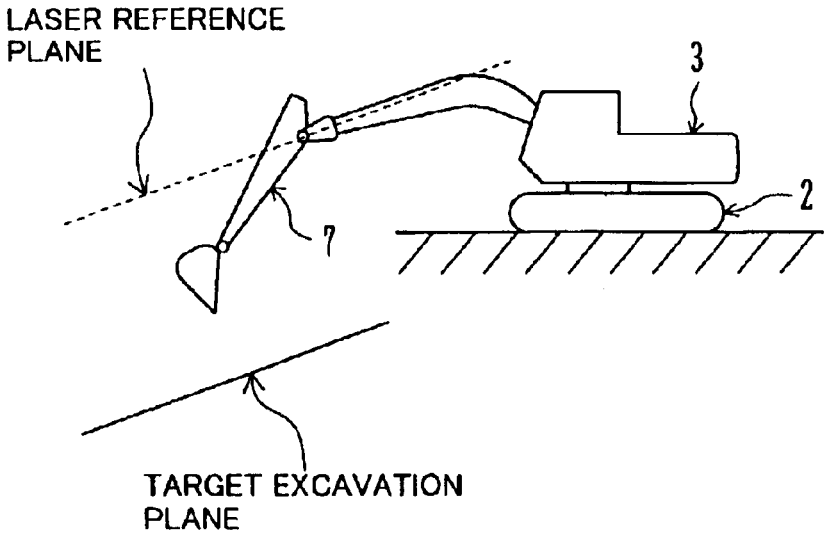
FIG. 6B is a representation for explaining the displayed contents.
Figure 7A:
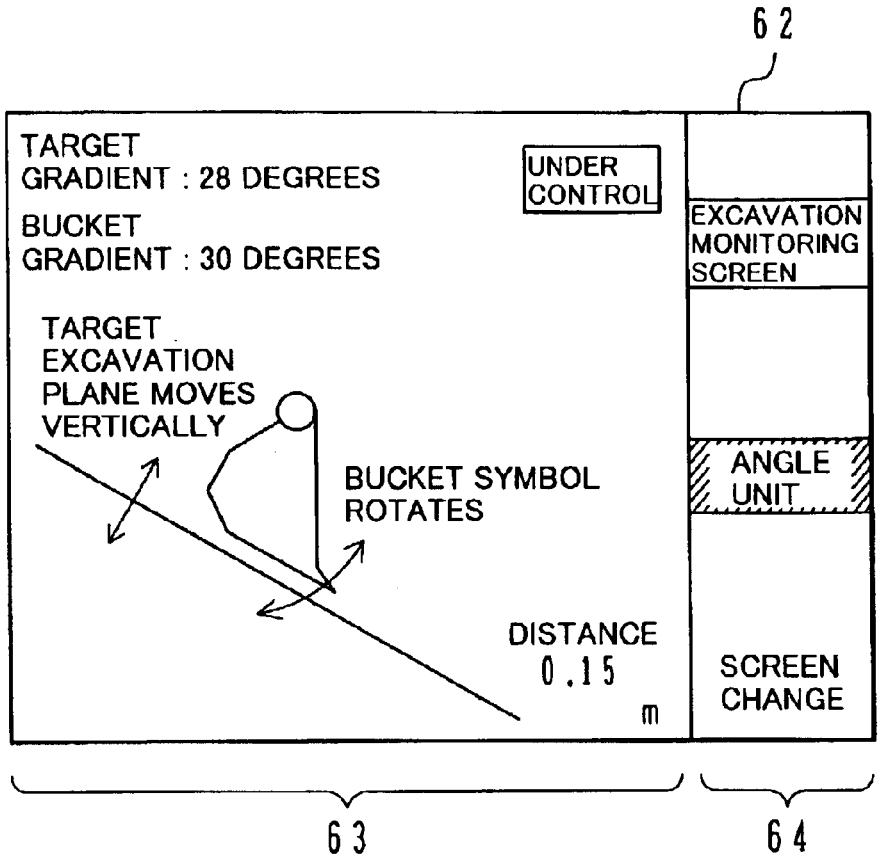
FIG. 7A is a representation showing an excavation monitoring screen displayed on the display unit.
Figure 7B:
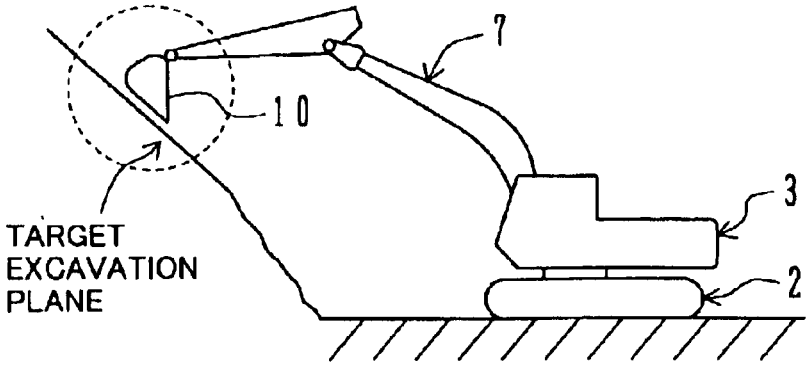
FIG. 7B is a representation for explaining the displayed contents.

FIGS. 5A, 6A and 7A show three kinds of screen images selectively displayed on the LCD 41*a* of the display 41. FIG. 5A shows a standard monitoring screen 60 for displaying attitude information of the body, FIG. 6A shows an excavation setting screen 61 for displaying the setting states of depth and gradient of the target excavation plane for automatic control, and FIG. 7A shows an excavation monitoring screen 62 for displaying, in an enlarged scale, relative positions of the target excavation plane set on the excavation setting screen and the bucket. FIGS. 5B, 6B and 7B are representations for explaining the contents displayed as the respective screens.

In FIGS. 5A, 6A and 7A, each of the screens 60, 61, 62 has a main screen area 63 in which objective information is displayed, and a menu area 64 that is positioned on the right side of the main screen area 63 and serves as a sub-screen area. In the menu area 64, a plurality of items are set depending on each type of screen information. Selection and execution of each item in the menu area 64 are effectuated using the up and down selection keys 43*a*, 43*b* and the decision key 43*e* on the operating unit 43. More specifically, a cursor for displaying items in reverse video one by one is disposed in the menu area 64. The subject represented by the item displayed in reverse video is executed by moving the cursor vertically to select a desired one of the items in the menu area 64 with manipulation of the up and down selection keys 43*a*, 43*b* on the operating unit 43, and then depressing the decision key 43*e*.

Details of the standard monitoring screen 60, the excavation setting screen 61, and the excavation monitoring screen 62 will be described below.

In FIG. 5A, the main screen area 63 of the standard monitoring screen 60 displays three kinds of information, i.e., the height of the fore end of the bucket 10, the transverse tilt angle of the body, and the bucket angle shown in FIG. 5B, which are computed by and sent from the control unit 50, in respective allocated areas by using numerical values and movable symbolic illustrations at the same time. The height of the fore end of the bucket 10 is illustrated by displaying a straight line indicating the ground surface, characters GL implying the ground level, and a bucket symbol indicating a height position, relative to the ground level, variable depending on the height of the fore end of the bucket 10, which is calculated by the control unit 50. The transverse tilt angle of the body is illustrated by displaying a body symbol tiltable depending on the transverse tilt angle of the body, which is calculated by the control unit 50. The bucket angle is illustrated by displaying a bucket symbol rotatable depending on the angle of the bucket 10, which is calculated by the control unit 50. The angle of the bucket 10 is represented by an angle relative to the ground (i.e., an angle of the bucket rear surface relative to a horizontal plane).

The menu area 64 of the standard monitoring screen 60 displays items "0-POINT SETTING", "ANGLE UNIT" and "SCREEN CHANGE". When "ANGLE UNIT" in the menu area 64 is selected and executed using the up and down selection keys 43*a*, 43*b* and the decision key 43*e* on the operating unit 43, the angle unit of the transverse tilt angle and the bucket angle both displayed in the main screen area 63 can be changed in the order of "°"→"%"→"proportion" in turn. When "0-POINT SETTING" is selected and executed, an arrow is moved to the current height position of the bucket 10. Thereafter, the control unit 50 calculates the bucket height with the current position being as a reference, and the calculated bucket height is displayed as a numerical value. When "0-POINT SETTING" is selected and executed again, the display reference is returned to an original one; namely, the bucket height position is displayed relative to the ground level GL.

When "SCREEN CHANGE" in the menu area 64 is selected and executed, the screen image is changed from the standard monitoring screen 60 to the excavation setting screen 61.

In FIG. 6A, the main screen area 63 of the excavation setting screen 61 displays not only the body in the form of a symbol, but also the setting states of depth and gradient of the target excavation plane for automatic control using numerical values and a straight line movable depending on the setting values. Further, in the case of using, as an external reference, a laser reference plane as shown in FIG. 6B, the laser reference plane is displayed in the form of a broken line movable vertically.

The menu area 64 of the excavation setting screen 61 displays items "CONTROL ON/OFF", "GADIENT", "DEPTH" and "SCREEN CHANGE". The gradient of the target excavation plane can be set by selecting "GRADIENT" in the menu area 64 with the selection keys 43*a*, 43*b* on the operating unit 43, and by manipulating the numerical value entry keys 43*c*, 43*d* and then depressing the decision key 43*e*. On that occasion, with the manipulation of the numerical value entry keys 43*c*, 43*d*, the numerical value of the gradient displayed on the screen is incremented or decremented, and the gradient of the straight line representing the target excavation plane is changed. Further, in the case of using the laser reference plane, the target excavation plane is displayed in parallel to the laser reference plane, and the gradient of the broken line representing the target excavation plane is also changed with the manipulation of the numerical value entry keys 43*c*, 43*d*. The laser reference plane is set and displayed upon an external reference setting switch (not shown) being depressed when a predetermined position of the front attachment (in the illustrated embodiment, fulcrum at which the arm is rotatable relative to the boom) matches with the laser reference plane. In the case of not employing the laser reference plane, the gradient of the target excavation plane is set and displayed with the center of the underside of the body, for example, being as a reference.

Likewise, the depth of the target excavation plane can be set by selecting "DEPTH" with the selection keys 43*a*, 43*b*, manipulating the numerical value entry keys 43*c*, 43*d*, and then depressing the decision key 43*e*. On that occasion, with the manipulation of the numerical value entry keys 43*c*, 43*d*, the numerical value of the setting depth displayed on the screen is incremented or decremented, and the straight line representing the target excavation plane is moved vertically. Further, in the case of using the laser reference plane, the depth of the target excavation plane is set as a value from the laser reference plane, and the target excavation plane is vertically moved relative to the laser reference plane. In the case of not employing the laser reference plane, the depth of the target excavation plane is set and displayed with the ground level, for example, being as a reference.

Moreover, warning can be displayed, as shown in FIG. 6A, by providing a hydraulic-working-fluid temperature sensor (not shown), taking in a signal from the temperature sensor to the control unit 50 to determine the temperature state of the hydraulic working fluid, and transmitting, from the control unit 50 to the display control unit 42, a command for displaying a message that arouses the operator attention to perform the warm-up operation.

When "CONTROL ON/OFF" in the menu area 64 is selected and executed using the up and down selection keys 43*a*, 43*b* and the decision key 43*e* on the operating unit 43, automatic control is started. During a period in which the automatic control is performed, "UNDER CONTROL" is displayed, as shown, on the screen. The display of "UNDER CONTROL" is continued even after change to another screen, i.e., even after the excavation setting screen 61 is changed to the standard monitoring screen 60 shown in FIG. 5A or the excavation monitoring screen 62, described later, shown in FIG. 7A. Additionally, the setting of the target excavation plane can be made regardless of whether the automatic control is turned ON or OFF. When "CONTROL ON/OFF" in the menu area 64 is selected and executed again, the automatic control is brought into an end.

When "SCREEN CHANGE" in the menu area 64 is selected and executed, the screen image is changed from the excavation setting screen 61 to the excavation monitoring screen 62.

In FIG. 7A, the main screen area 63 of the excavation monitoring screen 62 displays, in an enlarged scale, the positional relationship between the target excavation plane set on the excavation setting screen 61 and the bucket 10, as shown in FIG. 7B, by using numerical values and a movable symbolic illustration. As with the excavation setting screen 61, the target excavation plane is displayed using a straight line movable depending on the setting state. The bucket 10 is illustrated by displaying a bucket symbol that is moved and rotated depending on the attitude of the bucket 10 and the positional relationship between the bucket and the target excavation plane, which are calculated by the control unit 50. The operator is therefore able to perform works while always confirming the position of the bucket fore end and the position of the target excavation plane by looking at the excavation monitoring screen 62. The excavation monitoring screen is effective when the operator performs works in a location where he cannot visually confirm the position of the bucket fore end. Further, the works under such conditions can be performed with the aid of the excavation monitoring screen even when the automatic control is turned OFF.

The menu area 64 of the excavation monitoring screen 62 displays items "ANGLE UNIT" and "SCREEN CHANGE". When "ANGLE UNIT" is selected and executed, the angle unit can be changed in the same manner as with the standard monitoring screen 60.

When "SCREEN CHANGE" in the menu area 64 is selected and executed, the screen image is changed from the excavation monitoring screen 62 to the standard monitoring screen 60.

Figure 8:
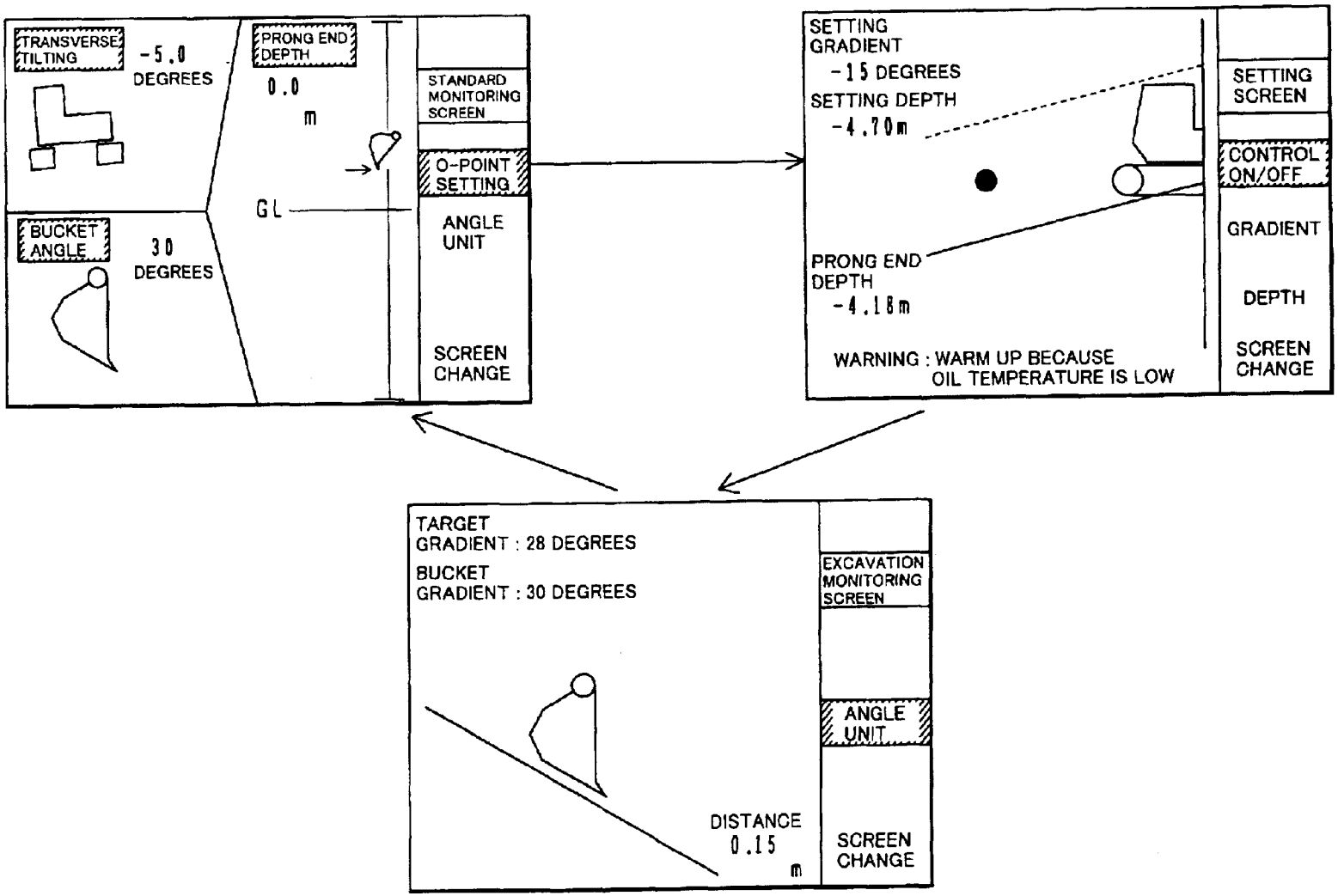
FIG. 8 is a representation showing a transition among the screens displayed on the display unit.

FIG. 8 shows a screen transition among "the standard monitoring screen 60", "the excavation setting screen 61", and "the excavation monitoring screen 62" described above. The operator is able to freely change the displayed contents in sequence by selecting and executing "SCREEN CHANGE" in the menu area 64, as described above, using the up and down selection keys 43*a*, 43*b* and the decision key 43*e* on the operating unit 43.

Processing steps executed in the display control unit 42 to perform the above-mentioned display control will be described with reference to flowcharts shown in FIGS. 9 to 16. These processing steps are executed in accordance with programs stored in the display control unit 42.

Figure 9:
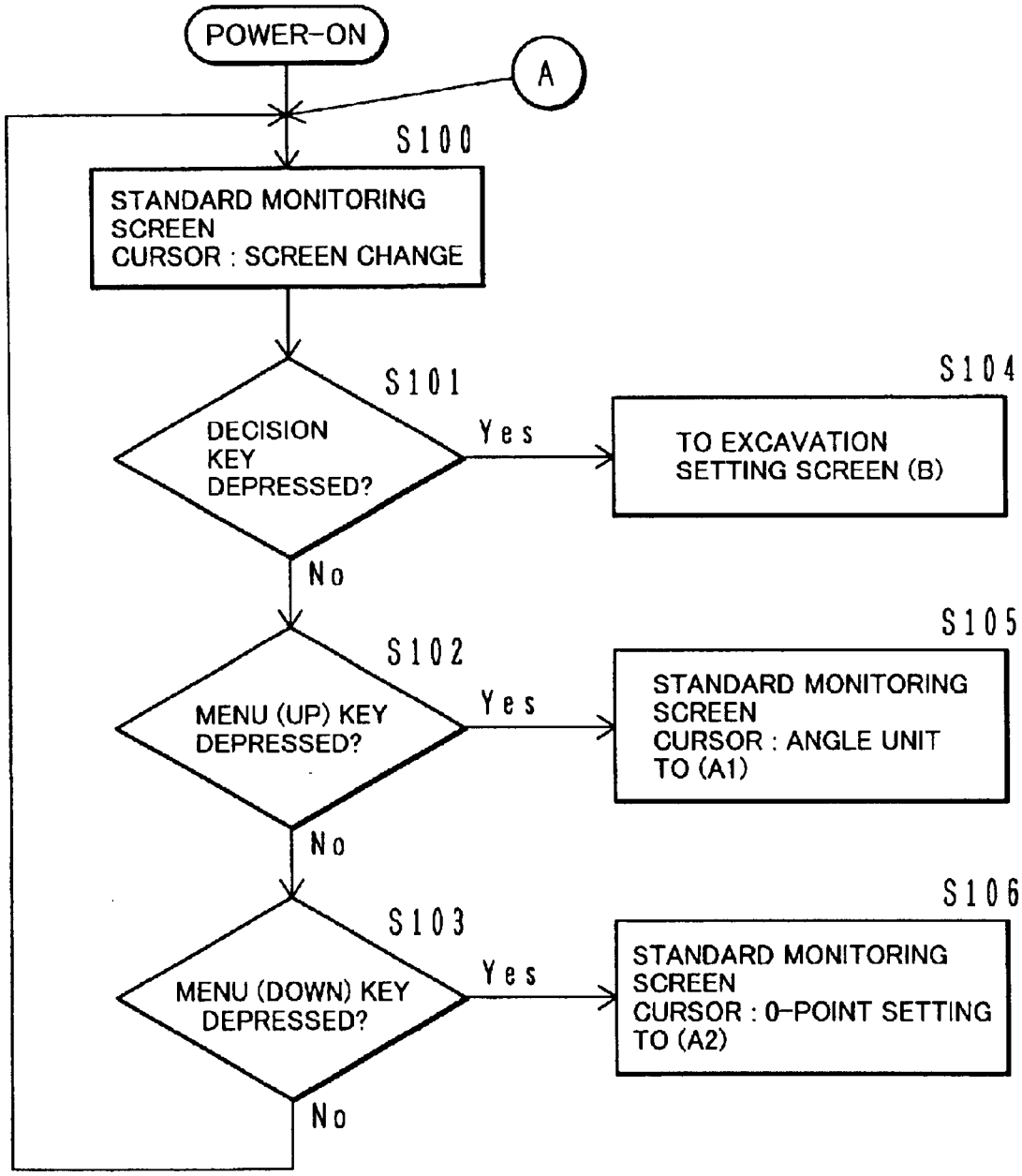
FIG. 9 is a flowchart showing processing steps when electric power is supplied to the display control unit.

FIG. 9 is a flowchart showing processing steps when electric power is supplied to the display control unit 42. Upon power-on of the display control unit 42, the standard monitoring screen 60 is displayed as an initial screen image, and the cursor initial position in the menu area 64 is set to "SCREEN CHANGE" (step S100). At this time, the angle unit of the transverse tilt angle and the bucket angle both displayed on the standard monitoring screen 60 is given as an initial angle unit of "°". Subsequently, the display control unit 42 determines whether the decision key 43*e* on the operating unit 43 is depressed (step S101), and then determines whether the up or down selection key 43*a*, 43*b* is depressed (steps S102, 103). Upon the decision key 43*e* being depressed, the screen image is changed to the excavation setting screen 61 (step S104). Upon the up selection key 43*a* being depressed, the cursor is moved to "ANGLE UNIT" (step S105). Upon the down selection key 43*b* being depressed, the cursor is moved to "0-POINT SETTING" (step S106).

Figure 10:
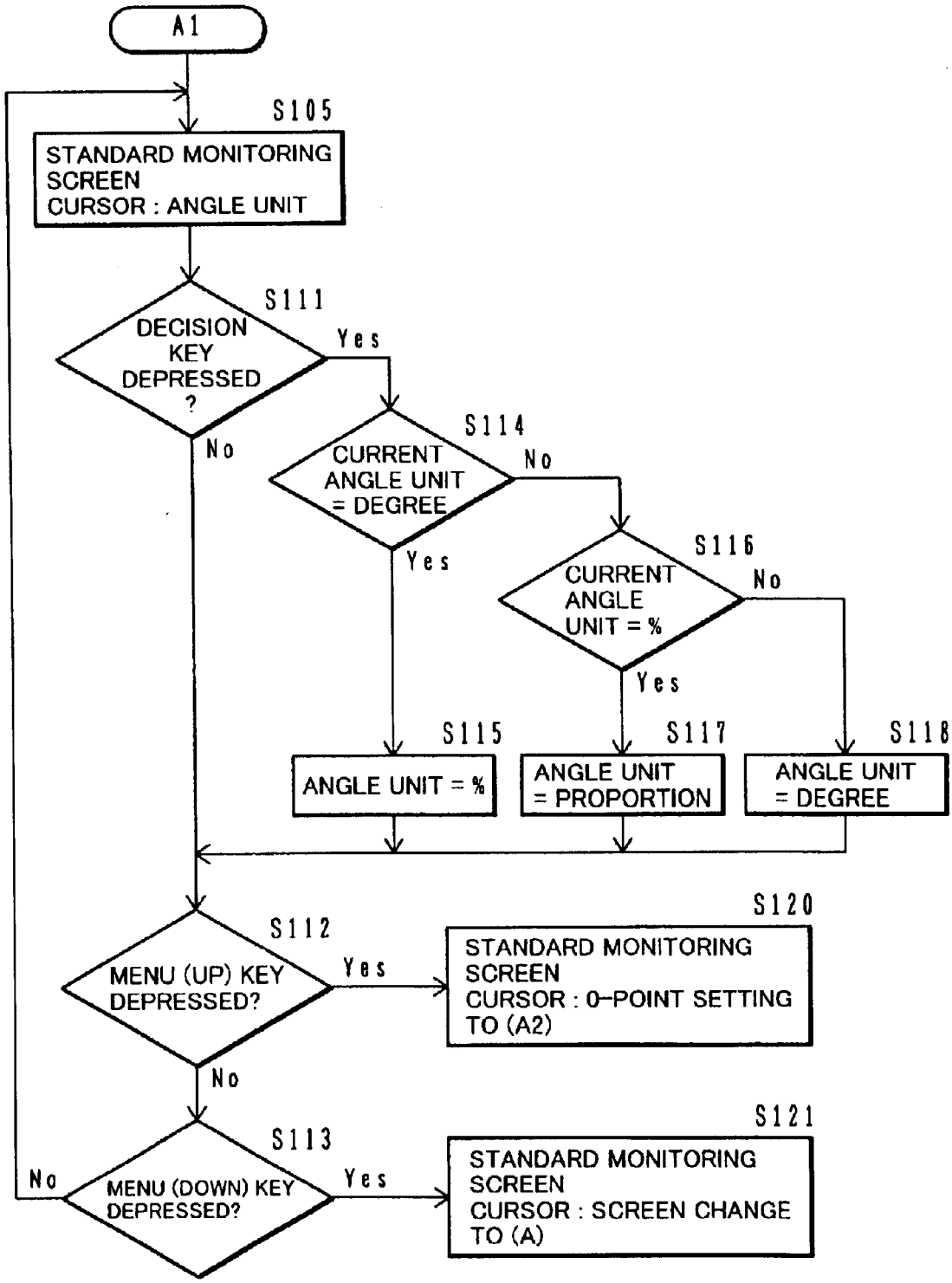
FIG. 10 is a flowchart showing processing steps when a cursor in a menu area of the standard monitoring screen is moved to "ANGLE UNIT".

FIG. 10 is a flowchart showing processing steps when the cursor in the menu area 64 of the standard monitoring screen 60 is moved to "ANGLE UNIT" in step S105 of the flowchart shown in FIG. 9. The display control unit 42 determines whether the decision key 43*e* on the operating unit 43 is depressed (step S111), and then whether the up or down selection key 43*a*, 43*b* is depressed (steps S112, 113). Upon the decision key 43*e* being depressed, the display control unit 42 determines whether the current angle unit is "°" (step S114), and then whether the current angle unit is "%" (step S116). Depending on the determination result, the angle unit is set to "%" (step S115), "proportion" (step S117), or "°" (step 5118). On the standard setting screen 60, "°" is displayed as the initial angle unit of the transverse tilt angle and the bucket angle. When the decision key 43*e* is depressed for the first time after the power-on, the determination in step S114 is responded by Yes because the current angle unit is "°", and hence the angle unit is changed to "%" in step S115. Thereafter, when the decision key 43*e* is depressed again, the determination in step 5114 is responded by No and the determination in step S116 is responded by Yes, whereupon the angle unit is changed to "proportion" in step S117. Subsequently, when the decision key 43*e* is depressed again, the determinations in steps S114, S115 are responded by No, and hence the angle unit is changed to "°" in step S118.

Further, upon the up selection key 43*a* being depressed, the cursor is moved to "0-POINT SETTING" (step S120). Upon the down selection key 43*b* being depressed, the cursor is moved to "SCREEN CHANGE" (step S121).

Figure 11:
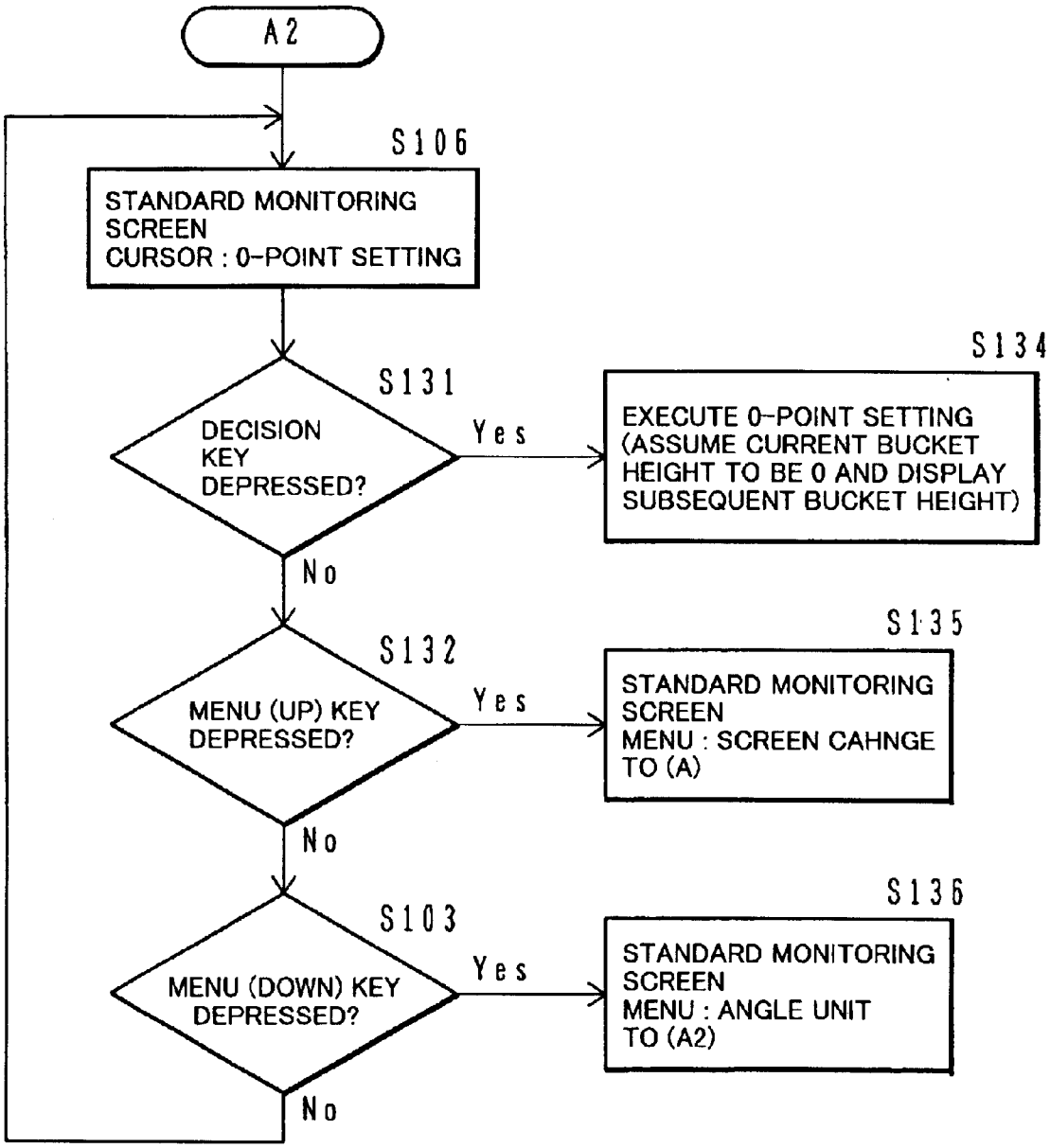
FIG. 11 is a flowchart showing processing steps when the cursor in the menu area of the standard monitoring screen is moved to "0-POINT SETTING".

FIG. 11 is a flowchart showing processing steps when the cursor in the menu area 64 of the standard monitoring screen 60 is moved to "0-POINT SETTING" in step S106 of the flowchart shown in FIG. 9. The display control unit 42 determines whether the decision key 43*e* on the operating unit 43 is depressed (step S131), and then whether the up or down selection key 43*a*, 43*b* is depressed (steps S132, 133). Upon the decision key 43*e* on the operating unit 43 being depressed, 0-point setting processing is executed. More specifically, the current bucket height is assumed to be 0, and the bucket height is displayed thereafter on that assumption. Further, upon the up selection key 43*a* being depressed, the cursor is moved to "SCREEN CHANGE" (step S135). Upon the down selection key 43*b* being depressed, the cursor is moved to "ANGLE UNIT" (step S136).

Figure 12:
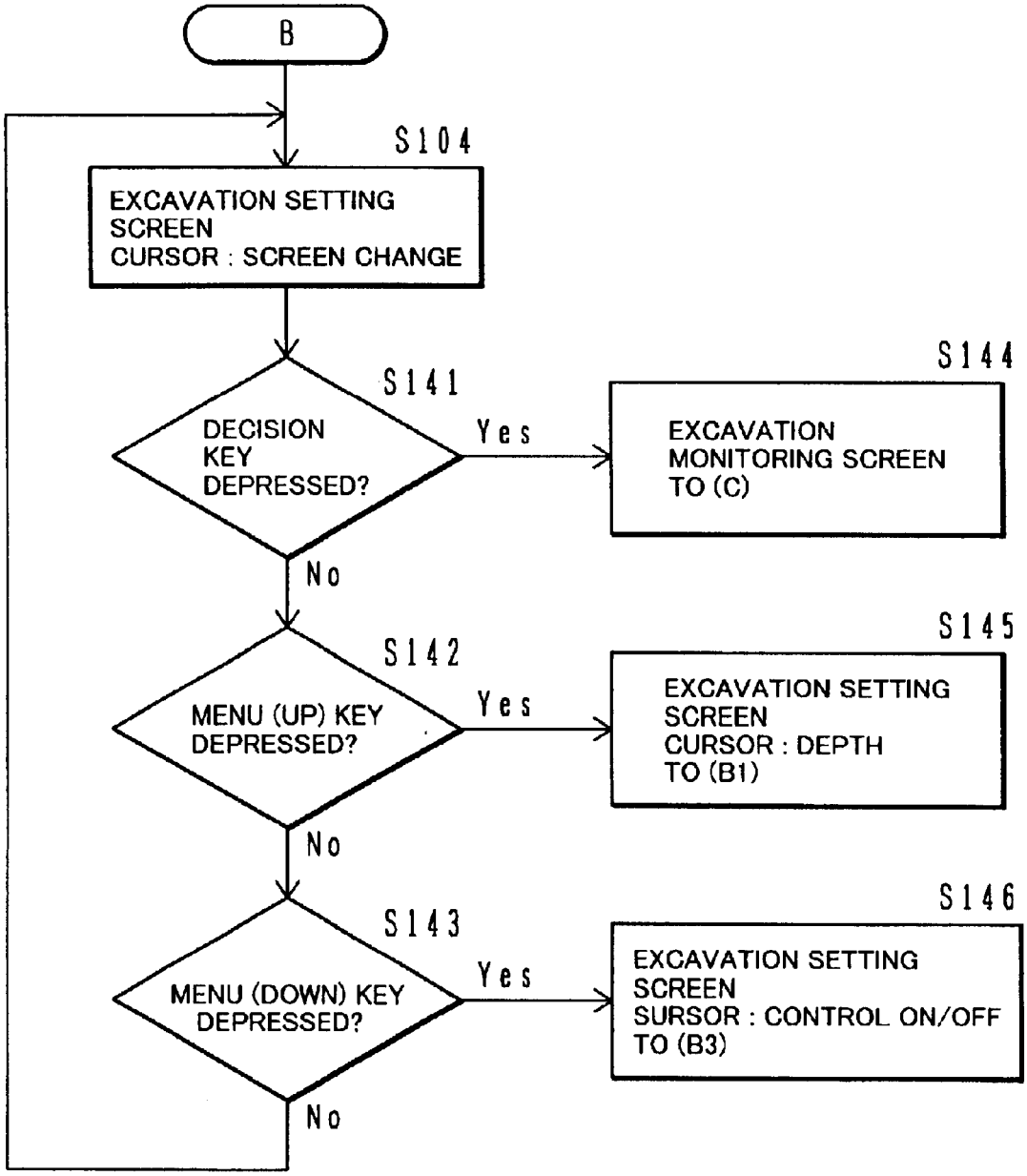
FIG. 12 is a flowchart showing processing steps when a screen image is changed from the standard monitoring screen to the excavation setting screen.

FIG. 12 is a flowchart showing processing steps when the screen image is changed to the excavation setting screen 61 in step S104 of the flowchart shown in FIG. 9. The display control unit 42 determines whether the decision key 43*e* on the operating unit 43 is depressed (step S141), and then whether the up or down selection key 43*a*, 43*b* is depressed (steps S142, 143). At this time, the cursor in the menu area is set to "SCREEN CHANGE". Upon the decision key 43*e* on the operating unit 43 being depressed, the screen image is changed to the excavation monitoring screen 62 (step S144). Upon the up selection key 43*a* being depressed, the cursor is moved to "DEPTH" (step S145). Upon the down selection key 43*b* being depressed, the cursor is moved to "CONTROL ON/OFF" (step S146).

Figure 13:
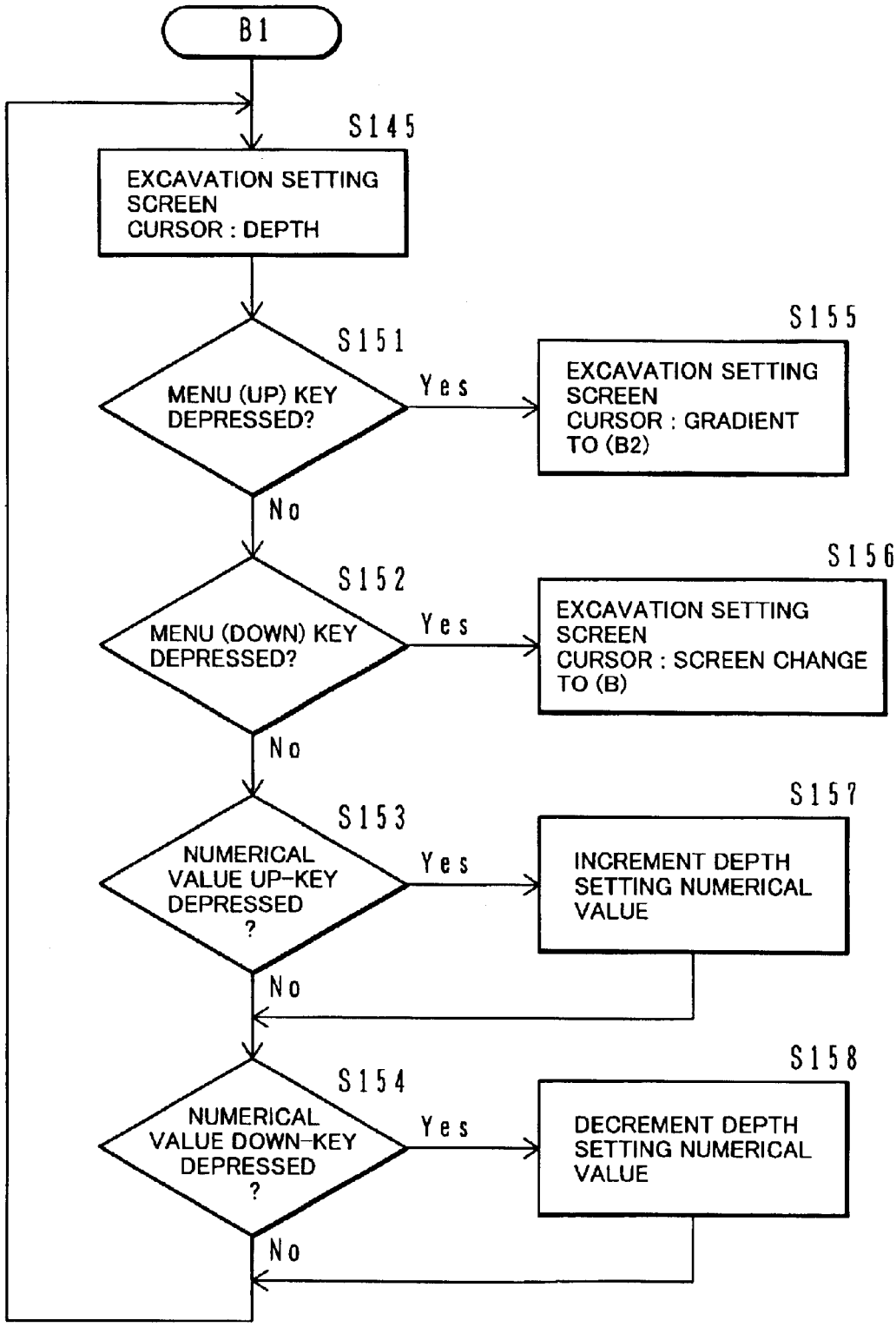
FIG. 13 is a flowchart showing processing steps when a cursor in a menu area of the excavation setting screen is moved to "DEPTH".

FIG. 13 is a flowchart showing processing steps when the cursor in the menu area 64 of the excavation setting screen 61 is moved to "DEPTH" in step S145 of the flowchart shown in FIG. 12. The display control unit 42 determines whether the up or down selection key 43*a*, 43*b* on the operating unit 43 is depressed (steps S151, 152), and then determines whether the numerical value increment or decrement entry key 43*c*, 43*d* is depressed (steps S153, 154). Upon the up selection key 43*a* being depressed, the cursor is moved to "GRADIENT" (step S155), and upon the down selection key 43*b* being depressed, the cursor is moved to "SCREEN CHANGE" (step S156). Further, upon the numerical value increment entry key 43*c* being depressed, the numerical value of the depth setting is incremented (step S157), and upon the numerical value decrement entry key 43*d* being depressed, the numerical value of the depth setting is decremented (step S158).

Figure 14:
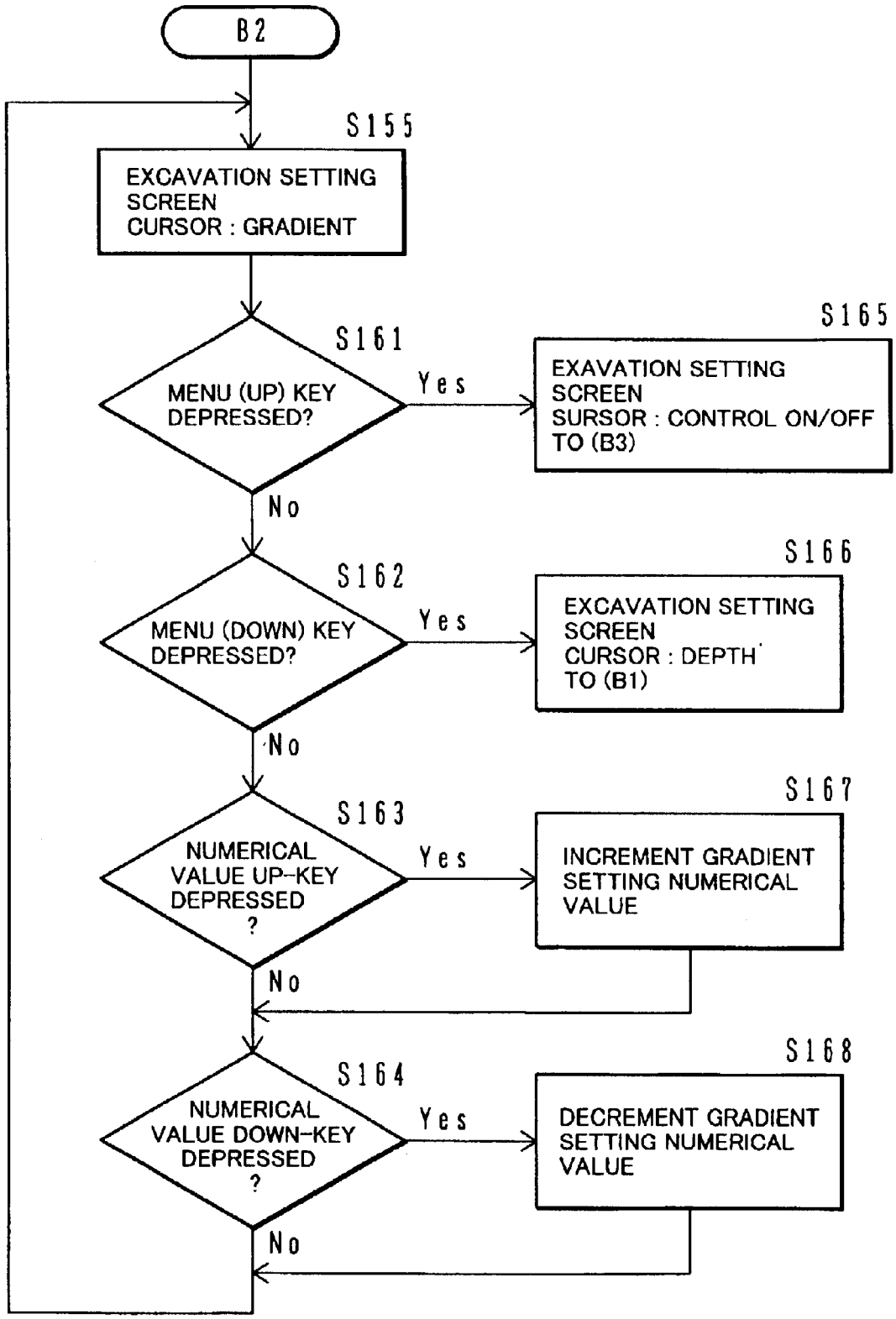
FIG. 14 is a flowchart showing processing steps when the cursor in the menu area of the excavation setting screen is moved to "GRADIENT".

FIG. 14 is a flowchart showing processing steps when the cursor in the menu area 64 of the excavation setting screen 61 is moved to "GRADIENT" in step S155 of the flowchart shown in FIG. 13. The display control unit 42 determines whether the up or down selection key 43*a*, 43*b* on the operating unit 43 is depressed (steps S161, 162), and then determines whether the numerical value increment or decrement entry key 43*c*, 43*d* is depressed (steps S163, 164). Upon the up selection key 43*a* being depressed, the cursor is moved to "CONTROL ON/OFF" (step S165), and upon the down selection key 43*b* being depressed, the cursor is moved to "DEPTH" (step S166). Further, upon the numerical value increment entry key 43*c* being depressed, the numerical value of the gradient setting is incremented (step S167), and upon the numerical value decrement entry key 43*d* being depressed, the numerical value of the gradient setting is decremented (step S168).

Figure 15:
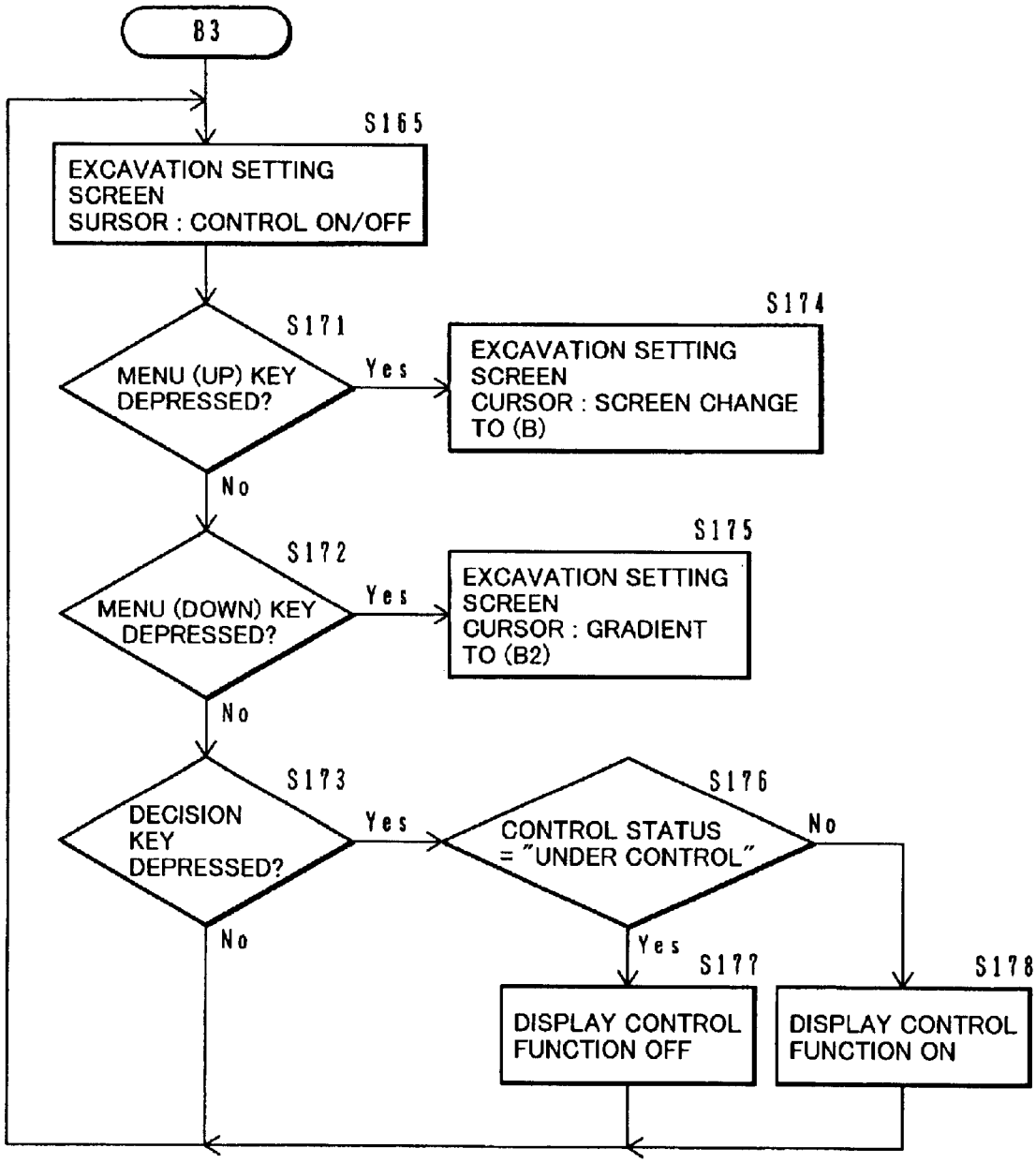
FIG. 15 is a flowchart showing processing steps when the cursor in the menu area of the excavation setting screen is moved to "CONTROL ON/OFF".

FIG. 15 is a flowchart showing processing steps when the cursor in the menu area 64 of the excavation setting screen 61 is moved to "CONTROL ON/OFF" in step S165 of the flowchart shown in FIG. 14. The display control unit 42 determines whether the up or down selection key 43*a*, 43*b* on the operating unit 43 is depressed (steps S171, 172), and then determines whether the decision key 43*e* is depressed (steps S173). Upon the up selection key 43*a* being depressed, the cursor is moved to "SCREEN CHANGE" (step S174), and upon the down selection key 43*b* being depressed, the cursor is moved to "GRADIENT" (step S175). Upon the decision key 43*e* being depressed, the display control unit 42 determines whether the machine is in the control status and "UNDER CONTROL" is displayed (step S176). If the machine is in the control status, the display of "UNDER CONTROL" is turned off and a command instructing control OFF is sent to the control unit (step S177). If the machine is not in the control status, the display of "UNDER CONTROL" is turned on and a command instructing control ON is sent to the control unit 50 (step S178).

Figure 16:
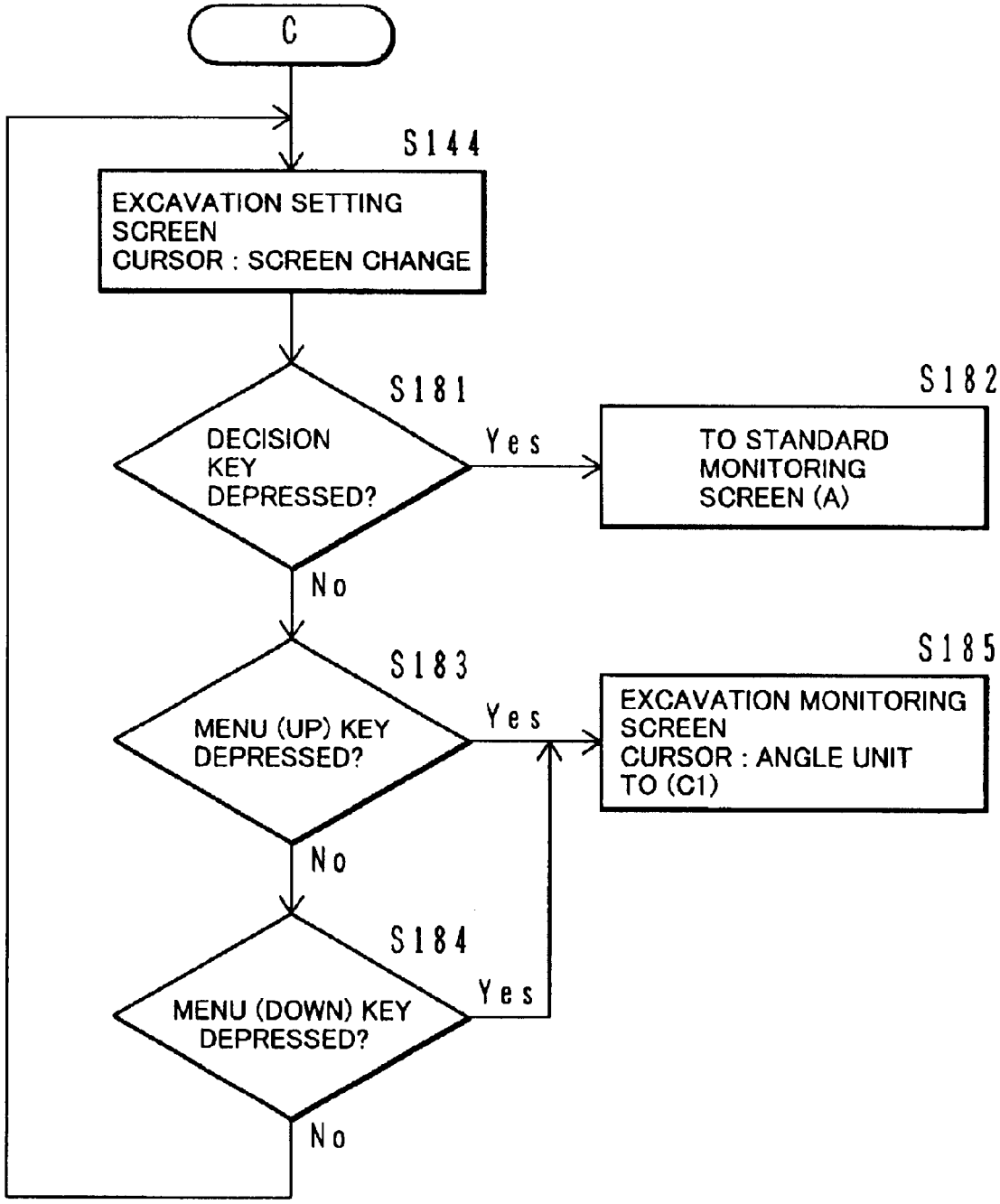
FIG. 16 is a flowchart showing processing steps when a screen image is changed from the excavation setting screen to the excavation monitoring screen.

FIG. 16 is a flowchart showing processing steps when the screen image is changed to the excavation monitoring screen 62 in step S144 of the flowchart shown in FIG. 12. At this time, the cursor is set to the position of "SCREEN CHANGE". Also, the angle unit of the bucket angle displayed on the excavation monitoring screen 62 is displayed as an initial unit of "°". Subsequently, the display control unit 42 determines whether the decision key 43*e* on the operating unit 43 is depressed (step S181), and then determines whether the up or down selection key 43*a*, 43*b* is depressed (steps S183, 184). Upon the decision key 43*e* on the operating unit 43 being depressed, the screen image is changed to the standard monitoring screen 60 (step S182). Upon the up or down selection key 43*a*, 43*b* being depressed, the cursor is moved to "ANGLE UNIT" (step S185).

Figure 17:
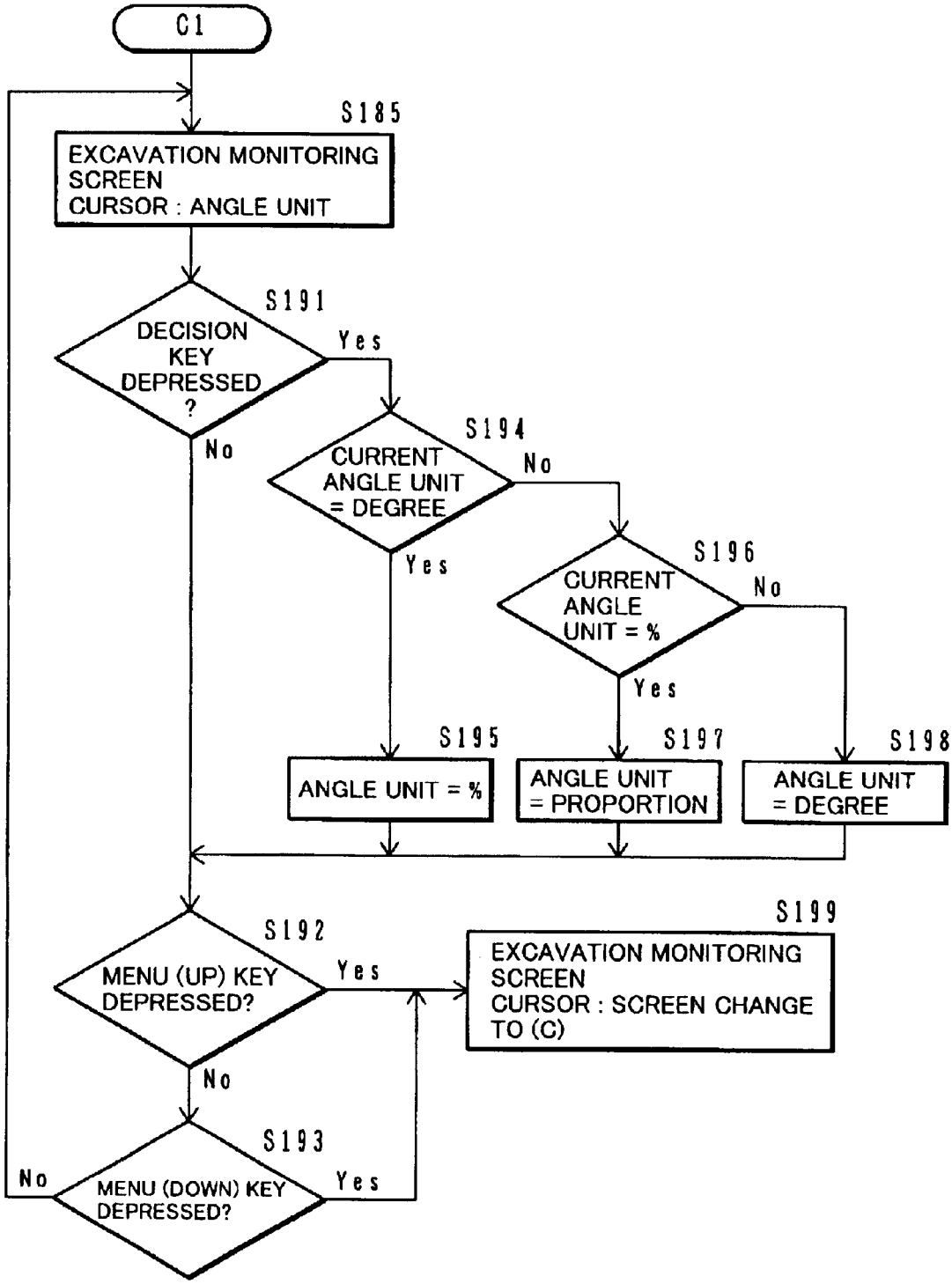
FIG. 17 is a flowchart showing processing steps when a cursor in a menu area of the excavation monitoring screen is moved to "ANGLE UNIT".

FIG. 17 is a flowchart showing processing steps when the cursor is moved to "ANGLE UNIT" in step S185 of the flowchart shown in FIG. 16. Steps S191 and S194 to S198 in FIG. 17 are the same as steps S111 and S114 to S118 of the flowchart shown in FIG. 10. In the case of the decision key 43*e* on the operating unit 43 being not depressed, if the up or down selection key 43*a*, 43*b* is depressed, the cursor is moved to "SCREEN CHANGE" (step S199).

This embodiment having the above-described construction can provide advantages given below.

1) On the excavation setting screen 61, not only the setting states of depth and gradient of the target excavation plane for automatic control is displayed using numerical values, but also the setting state of the target excavation plane is displayed using a straight line movable depending on entered numerical values of the depth and gradient in relation to the body displayed in the form of a symbol. Therefore, the operator is able to easily make various settings for the automatic control.

2) The menu area 64 including the item "SCREEN CHANGE" is prepared in each of three kinds of screens 60, 61, 62, particularly including the excavation setting screen 61, and those screens are changed from one to another by selecting and executing the item "SCREEN CHANGE" with key manipulation on the operating unit 43. Therefore, the operator is able to freely change those screens regardless of whether the machine is under the automatic control. For example, the operator can make setting for the automatic control on the excavation setting screen 61, perform works with the automatic control turned ON, and thereafter return to the standard monitoring screen 60 for looking at the attitude information. Also, even under the automatic control, after performing works with the excavation monitoring screen 62, the operator can return to the excavation setting screen 61 to confirm the setting state and to change the setting. Thus, it is possible to promptly select and display the information required for the operator, and to improve the work efficiency.

3) Even with the automatic control turned OFF, the screen image can be changed to the excavation monitoring screen 62, and the positional relationship between the target excavation plane and the bucket 10 is displayed in enlarged scale on the excavation monitoring screen 62 using numerical values and a symbolic illustration. Accordingly, even when works are performed in a location where the operator cannot visually confirm the position of the bucket fore end, the operator is able to perform the works while confirming the target excavation plane and the bucket position by looking at the excavation monitoring screen 62. This results in an improvement of the work efficiency.

4) Since entry of setting values and selection/execution of each of the items in the menu area are performed with key manipulation, the display unit can be more easily operated than a touch panel type display unit even in any site where hydraulic excavators are working. In addition, the life of the LCD used in the display unit can be prolonged.

5) When the automatic control is turned ON, characters "UNDER CONTROL" are displayed on all the three kinds of screens. Therefore, even when the screen image is changed to any of the three kinds of screens, the operator is able to know that the machine is currently under the automatic control, and hence to perform works without anxiety.

While one embodiment of the present invention has been described above, the present invention is not limited to the embodiment, and various modifications and additions can be made without departing from the scope of the spirit of the present invention. For example, in the embodiment described above, the standard monitoring screen 60 and the excavation monitoring screen 62 are prepared in addition to the screen (the excavation setting screen 61) on which the setting state of a target plane or area in works to be performed under automatic control is displayed using numerical values and a movable symbolic illustration. Instead of or in addition to those monitoring screen, other screens may also be displayed. The other conceivable screens include, for example, a meter information screen for displaying information from meters such as a fuel meter, a hydraulic pressure/temperature meter and an engine cooling-water temperature meter, an abnormality alarm information screen for displaying a water temperature abnormality and an oil temperature abnormality, and an operation information screen for displaying operation information regarding the engine rotational load, the excavation load, the travel load, the swing load, etc. Anyway, each of those screens includes a menu area used for changing the screens from one to another in accordance with an instruction provided from the operating unit.

Further, while the operating unit 43 is separate from the display 41 in the above-described embodiment, it may be integral with the display 41. In addition, the arrangement and form of the up and down selection keys 43*a*, 43*b*, the numerical value increment and decrement entry keys 43*c*, 43*d*, and the decision key 43*e* disposed on the operating unit 32 can be modified in various ways.

INDUSTRIAL APPLICABILITY

According to the present invention, a target plane or area in works to be performed under automatic control can be easily set, and the contents to be displayed can be freely changed regardless of whether the machine is under the automatic control. It is hence possible to promptly display the information that the operator wants to see, and to improve the work efficiency.

Also, according to the present invention, operability and durability of the display unit can be improved even in any site where construction machines are working.

Further, according to the present invention, when the automatic control is turned ON, characters "UNDER CONTROL" are displayed on all the three kinds of screens. Therefore, even when the screen image is changed to any of the three kinds of screens, the operator is able to know that the machine is currently under the automatic control, and hence to perform works without anxiety.

Moreover, according to the present invention, even when works are performed in a location where the operator cannot visually confirm the position of the bucket fore end, the operator is able to perform the works while confirming the target excavation plane and the bucket position by looking at the screen. The works can also be performed even with the automatic control turned OFF. This results in an improvement of the work efficiency.

What is claimed is:

1. A display unit for a construction machine including a front attachment and control means for carrying out an automatic control of said front attachment, said display unit being provided in a cab of said construction machine, and comprising a display portion for displaying positional information for said front attachment and setting information for said automatic control of said front attachment, and an operating portion for instructing change of contents displayed on said display portion and input of said setting information, thereby controlling the displayed contents in accordance with an instructions from said operating portion, wherein said display portion is capable of selectively displaying a first screen for displaying the setting state of a target plane or area in works to be performed under said automatic control by using numerical values and a movable symbolic illustration, and at least one second screen for providing another display, said first screen being a screen used when said input of setting information is instructed by said operating portion, and said movable symbolic illustration displayed on said first screen including a line representing said setting state of the target plane or area in works, said line being movable depending on the instruction of said operating portion when said input of setting information is instructed by said operating portion, each of said first and second screens having a menu area used for changing said first and second screens from one to the other in accordance with an instruction from said operating portion.

2. A display unit for a construction machine according to claim 1, wherein said operating portion includes selection keys, numerical value entry keys, and a decision key;

said first screen changes display of the setting state upon manipulation of said numerical value entry keys; and said menu area in each of said first and second screens is used for changing said first and second screens from one to the other with manipulation of said selection keys and said decision key.

3. A display unit for a construction machine according to claim 1, wherein when the automatic control is started, each of said first and second screens displays that said construction machine is under control.

4. A display unit for a construction machine according to claim 1, wherein said second screen includes a screen for displaying, in enlarged scale, the positional relationship of a fore end of said front attachment relative to the target plane or area in said works by using a movable symbolic illustration.

5. A display unit for a construction machine according to claim 1, wherein said menu area has a plurality of items including an item of screen change;

said operating portion includes first entry means for selecting a desired one of the plurality of items in said menu area, and second entry means for deciding the selection made by said first entry means; and said display portion changes said first and second screens from one to the other when said item of screen change is selected by said first entry means and the selection of said item of screen change is decided by said second entry means.

6. A display unit for a construction machine according to claim 1, wherein said menu area of said first screen has an item of screen change and an item of automatic control ON/OFF; and said display portion changes said first and second screens from one to the other regardless of the selected state of said item of automatic control ON/OFF when selection of said item of screen change is instructed from said operating portion.

7. A display unit for a construction machine according to claim 1, wherein said menu area of said first screen has a plurality of items including an item of screen change and an item of automatic control ON/OFF;

said menu area said second screen has a plurality of items including an item of screen change;

said operating portion includes first entry means for selecting a desired one of the plurality of items in said menu area, and second entry means for deciding the selection made by said first entry means; and when one item is selected by said first entry means and the selection of the one item is decided by said second entry means, said display portion executes the selected item.

8. A display unit for a construction machine including a front attachment and control means for carrying out an automatic control of said front attachment, said display unit being provided in a cab of said construction machine including, and comprising a display portion for displaying positional information of said front attachment and setting information for said automatic control of said front attachment, and an operating portion for instructing change of contents displayed on each said display portion input of said setting information, thereby controlling the displayed contents in accordance with an instruction from said operating portion, wherein said display portion is capable of selectively displaying a first screen for displaying the setting state of a target plane or area in works to be performed under said automatic control by using numerical values and a movable symbolic illustration, a second screen for displaying states of a body of said construction machine and said front attachment by using numerical values and a movable symbolic illustration, and a third screen for displaying, in enlarged scale, the positional relationship of a fore end of said front attachment relative to the target plane or area in said works by using a movable symbolic illustration, said first screen being a screen used when said input of setting information is instructed by said operating portion, and said movable symbolic illustration displayed on said first screen including a line representing said setting state of the target plane or area in works, said line being movable depending on the instruction of said operating portion when said input of setting information is instructed by said operating portion, and each of said first, second and third screens having a menu area used for changing said first, second and third screens from one to another in accordance with an instruction from said operating portion.

9. A display control unit for a construction machine including a front attachment and control means for carrying out an automatic control of said front attachment, said display control unit being provided in a cab of said construction machine for controlling, in accordance with an instruction from an operating portion, contents displayed on a display portion for displaying positional information of said front attachment and setting information for said automatic control of said front attachment, said display control unit comprising:

first control means for causing said display portion to selectively display a first screen for displaying the setting state of a target plane or area in works to be performed under automatic control by using numerical values and a movable symbolic illustration, and at least one second screen for providing another display, and to display a menu area including an item of screen change in each of said first and second screens;

second control means for processing said item of screen change in accordance with an instruction from said operating portion and changing said first and second screens from one to the other; and said first control means being configured to display said first screen such that said movable symbolic illustration displayed on said first screen includes a line representing said setting state of the target plane or area in works, said line being movable depending on the instruction of said operating portion when said input of setting information is instructed by said operating portion.

* * * * *